US010821750B2

(12) United States Patent
Niwa et al.

(10) Patent No.: US 10,821,750 B2
(45) Date of Patent: Nov. 3, 2020

(54) RECORDING APPARATUS

(71) Applicant: SEIKO EPSON CORPORATION, Tokyo (JP)

(72) Inventors: Keisuke Niwa, Shiojiri (JP); Yasuo Sunaga, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/421,641

(22) Filed: May 24, 2019

(65) Prior Publication Data

US 2019/0358970 A1 Nov. 28, 2019

(30) Foreign Application Priority Data

May 28, 2018 (JP) ..... 2018-101249

(51) Int. Cl.
*B41J 3/60* (2006.01)
*B41J 13/00* (2006.01)
*B41J 11/00* (2006.01)

(52) U.S. Cl.
CPC ..... *B41J 11/007* (2013.01); *B41J 13/009* (2013.01)

(58) Field of Classification Search
CPC .. B41J 13/009; B41J 13/0045; B41J 13/0036; B41J 3/60
See application file for complete search history.

(56) References Cited

U.S. PATENT DOCUMENTS

| | | | | |
|---|---|---|---|---|
| 5,449,163 | A | 9/1995 | Wong et al. | |
| 2008/0191413 | A1 | 8/2008 | Fujita et al. | |
| 2008/0239053 | A1* | 10/2008 | Sakano | B41J 3/60 347/104 |
| 2016/0288546 | A1 | 10/2016 | Mizutani | |
| 2017/0157953 | A1* | 6/2017 | Kodama | B65H 29/125 |

FOREIGN PATENT DOCUMENTS

| | | |
|---|---|---|
| JP | 2015-051524 | 3/2015 |
| JP | 2016-193555 | 11/2016 |

* cited by examiner

*Primary Examiner* — Scott A Richmond
(74) *Attorney, Agent, or Firm* — Workman Nydegger

(57) ABSTRACT

A recording apparatus includes a recording unit that performs recording on a recording medium, a first transport path through which the recording medium is transported in a first direction during the recording by the recording unit, and a second transport path which is connected to the first transport path at a downstream position of the recording unit in the first direction and through which the recording medium recorded by the recording unit is transported on a path that is different from the first transport path in a second direction that is different from the first direction. A transport distance between a position of the recording unit and a connecting position where the first transport path and the second transport path are connected to each other is configured to be changed.

7 Claims, 13 Drawing Sheets

RECORDING APPARATUS

The present application is based on, and claims priority from JP Application Serial Number 2018-101249, filed May 28, 2018, the disclosure of which is hereby incorporated by reference herein in its entirety.

BACKGROUND

1. Technical Field

The present disclosure relates to a recording apparatus including a recording unit that performs recording on a recording medium and a transport path through which the recording medium is reversed after the recording.

2. Related Art

This type of recording apparatus includes, for example, a transport unit that transports a medium and a recording unit that ejects a liquid such as an ink to the medium to perform recording (printing) (for example, JP-A-2016-193555). The recording apparatus disclosed in JP-A-2016-193555 includes a transport roller mechanism disposed upstream of the recording unit in a transport direction, a discharge roller mechanism disposed downstream of the recording unit in the transport direction, and a switchback roller mechanism. A transport path has a first transport path that is a path extending from the transport roller mechanism to the switchback roller mechanism and a second transport path formed below the first transport path. The medium is recorded by the recording unit while being transported along the first transport path. The completely recorded medium M is discharged to a predetermined position by the discharge roller mechanism or the switchback roller mechanism, is switched back by the switchback roller mechanism, and is transported along the second transport path in a direction (a second direction) that is opposite to the transport direction (a first direction) at a time of the recording. Thus, the medium M is reversed back and forth while being transported in the second direction. Thereafter, the medium M is joined to the first transport path on an upstream side of the recording unit and is fed again, so that recording on a second surface is performed.

In the recording apparatus, since the second transport path for reversing a medium is included, the medium is continuously fed. While the printing on the first surface (for example, a surface) is terminated and a first medium moves along the second transport path, printing on a first surface of a second medium is performed. When the printing on the first surface of the second recording medium is completed, the printing on a second surface (for example, a rear surface) of the first medium re-fed from the second transport path is performed. Subsequently, the printing on a second surface of the second medium re-fed from a reverse path is performed. In this way, double-sided printing on a plurality of sheets can be simultaneously processed while alternately performing printing on two media by circulating and transporting the two media.

However, in the recording apparatus disclosed in JP-A-2016-193555, since a following medium during printing cannot enter a switchback roller mechanism until printing on a first surface is terminated and a switchback operation of a preceding medium discharged once is terminated, a standby time during which the printing on the following medium is temporarily stopped is required, and throughput of the printing is reduced due to the standby time. Therefore, in order to shorten this type of standby time, a distance between the discharge roller mechanism and the switchback roller mechanism may increase. However, when the distance increases, the double-sided printing on a plurality of sheets can be performed at a high speed. However, when the double-sided printing on one sheet is performed, it is necessary to transport the medium by the switchback roller mechanism on the transport path having the same length as the length when the double-sided printing on a plurality of sheets is performed. Thus, a time during which the medium is reversed is required by an amount by which the length of the transport path increases, and thus it is difficult to perform the double-sided printing at a high speed. The printing in which the medium is reversed on a path passing through the second transport path is not limited to the double-sided printing, and may be applied to the face-down discharge in which the medium on which the single-sided printing is performed is recorded, is reversed, and is then discharged while the recording surface is directed to the lower side.

SUMMARY

An advantage of some aspects of the present disclosure is to provide a recording apparatus which can improve throughput in both printing on one sheet and printing on a plurality of sheets in printing in which an operation of reversing a medium is accompanied after one surface among both surfaces of the recording medium is recorded.

Hereinafter, means of the disclosure and operation effects thereof will be described.

According to an aspect of the present disclosure, a recording apparatus includes a recording unit that performs recording on a recording medium, a first transport path through which the recording medium is transported in a first direction during the recording by the recording unit, and a second transport path which is connected to the first transport path at a downstream position of the recording unit in the first direction and through which the recording medium recorded by the recording unit is transported on a path that is different from the first transport path in a second direction that is different from the first direction, in which a transport distance between a position of the recording unit and a connecting position where the first transport path and the second transport path are connected to each other is configured to be changed.

With this configuration, since the transport distance between the position of the recording unit and the connecting position where the first transport path and the second transport path are connected to each other can be changed, in the case of the double-sided printing on one sheet, the transport distance from the position of the recording unit is set as the first transport distance. In the case of the double-sided printing on a plurality of sheets, the transport distance from the position of the recording unit to the connecting position is changed to the second transport distance that is longer than the first transport distance. Thus, in the printing in which the operation of reversing the medium is accompanied after recording on one surface among both surfaces of the recording medium, throughput in both the printing on one sheet and the printing on a plurality of sheets can be improved. For example, the throughput in both the double-sided printing on one sheet and the double-sided printing on a plurality of sheets can be improved.

In the recording apparatus, the recording apparatus further includes a plurality of roller pairs that are configured to apply a transporting force in the first direction and the second direction to the recording medium at a downstream position of the recording unit in the first direction, in which the transport distance is configured to be changed by changing one of the roller pairs that applies the transporting force to the recording medium in the second direction.

With this configuration, the transport distance is changed by changing the roller pair that applies a transporting force to the recording medium in the second direction among the plurality of roller pairs that can apply a transporting force to the recording medium in the first direction and the second direction at the downstream position of the recording unit in the first direction. During the printing on one sheet with reversal (for example, during the double-sided printing), the medium is transported in the second direction by the roller pair of which the transport distance is set as the first transport distance among the plurality of roller pairs. During the printing on a plurality of sheets with reversal, (for example, during the double-sided printing), the medium is transported in the second direction by the roller pair of which the transport distance is set as the second transport distance that is longer than the first transport distance among the plurality of roller pairs. Thus, throughput in both printing on one sheet and printing on a plurality of sheets in printing in which an operation of reversing the medium is accompanied after one surface among both surfaces of the recording medium is recorded can be improved. For example, the throughput in both the double-sided printing on one sheet and the double-sided printing on a plurality of sheets can be improved.

In the recording apparatus, the recording apparatus further includes a roller pair that is configured to apply a transporting force in the first direction and the second direction to the recording medium at a downstream position of the recording unit in the first direction, in which the transport distance is configured to be changed by changing a position of the roller pair.

With this configuration, the transport distance is changed by changing a position of the roller pair that is configured to apply a transporting force in the first direction and the second direction to the recording medium at a downstream position of the recording unit in the first direction. During the double-sided printing on one sheet with reversal, the roller pair is disposed at a position (a first position) where the transport distance is set as the first transport distance, and the roller pair at this position transports the medium after the recording in the second direction. During the printing in a plurality of sheets, the roller pair is disposed at a position (a second position) where the transport distance is set as the second transport distance that is longer than the first transport distance, and the roller pair at this position transports the medium after the recording in the second direction. Thus, throughput in both printing on one sheet and printing on a plurality of sheets in printing in which an operation of reversing the medium is accompanied after one surface among both surfaces of the recording medium is recorded can be improved. For example, the throughput in both the double-sided printing on one sheet and the double-sided printing on a plurality of sheets can be improved.

In the recording apparatus, the position of the roller pair may be changed along a transport direction of the recording medium.

With this configuration, the position of the roller pair is changed along the transport direction of the recording medium. Thus, it is possible to change the transport distance between the first transport distance and the second transport distance to a relatively large value.

In the recording apparatus, the position of the roller pair may be changed along a direction intersecting a transport direction of the recording medium and a width direction of the recording medium.

With this configuration, the position of the roller pair is changed along the direction intersecting the transport direction of the recording medium and the width direction of the recording medium. Thus, the transport distance may be changed to the relatively large value as compared to a distance by which the position of the roller pair is changed.

In the recording apparatus, the recording apparatus further includes a roller pair that is configured to apply a transporting force in the first direction and the second direction to the recording medium at a downstream position of the recording unit in the first direction, and a deformable member that is disposed upstream of the roller pair in the first direction, and is configured to be displaced between an advanced position where the deformable member is advanced to the first transport path and a retracted position where the deformable member is more retracted from the first transport path than the advanced position, in which the transport distance is changed by deforming the recording medium transported on the first transport path more by the deformable member disposed at the advanced position than by the deformable member disposed at the retracted position.

With this configuration, as the deformable member is displaced from the retracted position to the advanced position advanced to the first transport path, the recording medium transported on the first transport path is more largely deformed than when the medium is disposed at the retracted position. As a result, the transport distance between the retracted position and the advanced position where the deformable member is disposed is changed depending on whether or not the recording medium is deformed and the size of deformation of the recording medium. Thus, the transport distance between the position of the recording unit and the connecting position can be changed using a relatively simple configuration. During the printing on one sheet with reversal with the medium, the deformable member is disposed at the retracted position where the transport distance is set as the first transport distance. Further, during the printing on a plurality of sheets with reversal of the medium, the deformable member is disposed at the advanced position where the transport distance is set as the second transport distance that is longer than the first transport distance. Thus, throughput in both printing on one sheet and printing on a plurality of sheets in printing in which an operation of reversing the medium is accompanied after one surface among both surfaces of the recording medium is recorded can be improved. For example, the throughput in both the double-sided printing on one sheet and the double-sided printing on a plurality of sheets can be improved.

In the recording apparatus, the recording apparatus includes a first transport mechanism that transports the recording medium along the first transport path in the first direction in an area including an area facing the recording unit, and a second transport mechanism that transports the recording medium along the second transport path in the second direction.

With this configuration, the medium can be transported along the first transport path in the first direction by the first transport mechanism, and the medium can be transported along the second transport path in the second direction by the second transport mechanism.

In the recording apparatus, the second transport path may be a reverse path that is joined to the first transport path at an upstream position of the recording unit in the first direction.

With this configuration, the medium transported on the second transport path after recording on the first surface (a single surface) is performed is sent and reversed from a joint point with the first transport path to the first transport path or is reversed before the joining, is transported on the first transport path, and is then re-fed. For example, double-sided recording is performed by performing recording on a second surface opposite to the recorded first surface of the re-fed medium. Further, face-down discharge is performed in which after recording on the one surface of the medium is performed, after the medium is reversed, the medium is discharged without recording, so that a plurality of media are arranged in an order of recording.

DESCRIPTION OF EXEMPLARY EMBODIMENTS

Figure 1:
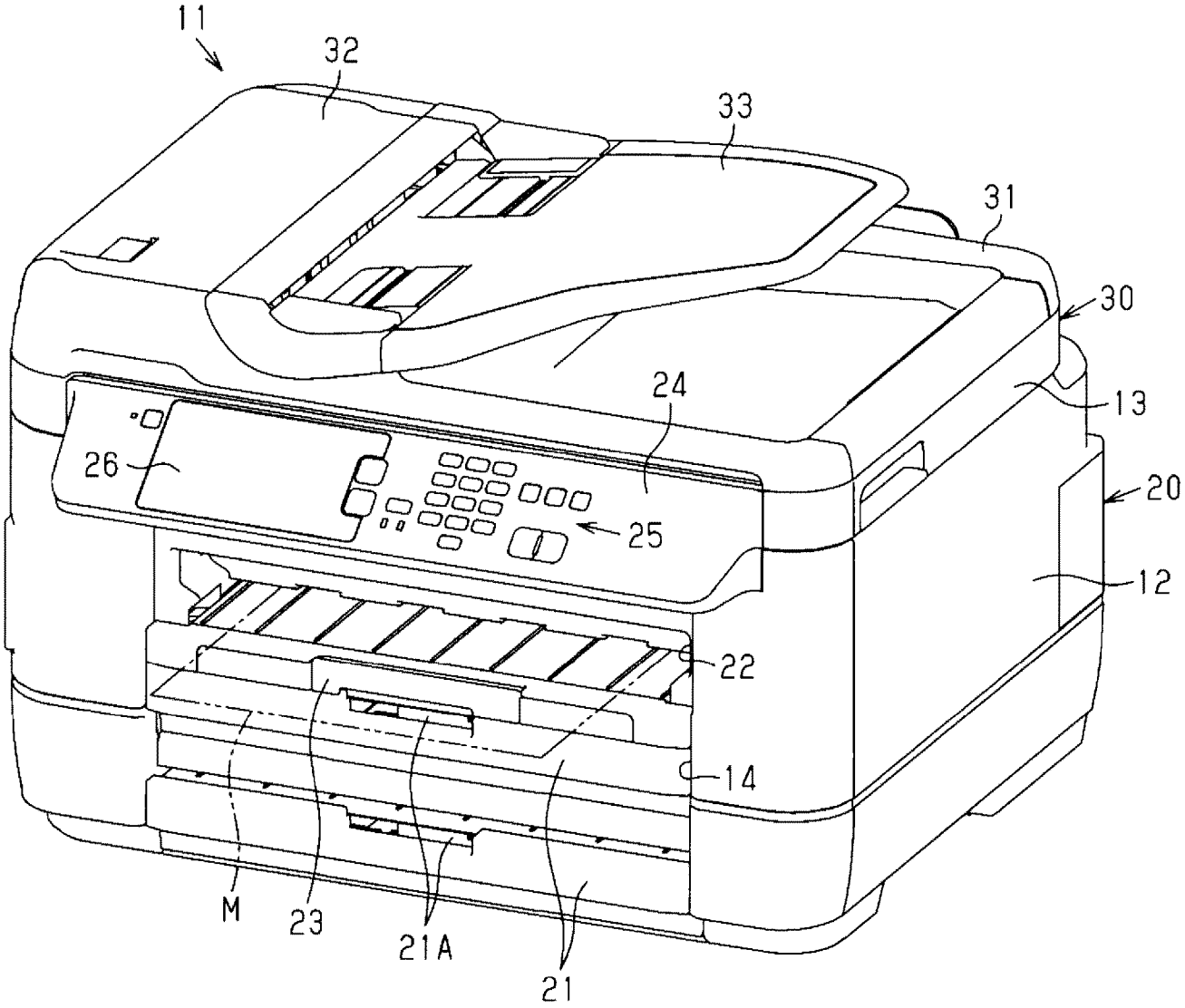
FIG. 1 is a perspective view illustrating a recording apparatus according to a first embodiment.

Hereinafter, an embodiment of a recording apparatus will be described with reference to the drawings. A recording apparatus 11 illustrated in FIG. 1 is an ink jet printer using a serial printing method. As illustrated in FIG. 1, the recording apparatus 11 includes a rectangular parallelepiped casing 12 and a cover 13 openably and closably provided on the casing 12. The recording apparatus 11 illustrated in FIG. 1, which is an example of a multi-functional periphery, has a printer unit 20 occupying most of the casing 12 and a scanner unit 30 configured by an upper end portion of the casing 12 and the cover 13. A cassette 21 in which the medium M such as a paper sheet is accommodated is inserted into a recess 14 opened in a lower portion of a front surface of the casing 12. In an example illustrated in FIG. 1, although the cassette 21 is provided vertically in two stages, the cassette 21 may be provided in one stage or may be provided in the vertical direction Z in three or more of stages. A to-be-operated portion 21A that can be detachably attached to the cassette 21 by hanging a finger thereon by a user is provided in a central portion of a front surface of each cassette 21.

In the casing 12, a discharge port 22 through which the printed medium M is discharged is opened on an upper side of the cassette 21. An expandable discharge tray 23 (a stacker) that receives the discharged medium M after the printing is provided at a lower portion of the discharge port 22. In the casing 12, an operation panel 24 is disposed above the discharge port 22. An operation unit 25 including a plurality of switches operated when the user provides an instruction to the recording apparatus 11 and a display unit 26 on which a menu or the like is displayed are provided in the operation panel 24. The operation unit 25 includes operation switches such as a power switch, a selection switch operated when an item of the menu of the display unit 26 is selected, a print starting switch that instructs printing, and a copy starting switch that instructs copying.

Further, as illustrated in FIG. 1, the cover 13 openably and closably provided on the casing 12 through a not-illustrated hinge serves as a document stand cover 31 of the scanner unit 30 in this example. An automatic document feeder 32 including a document tray 33 on which a plurality of documents can be placed (set) is mounted on the document stand cover 31. The scanner unit 30 includes a flat-bed-type scanner function of placing a document on a document stand (a glass surface) exposed when the document stand cover 31 is opened and reading the document and a sheet-feeder-type scanner function of automatically feeding and reading the document set on the document tray 33 one by one. Further, the document can be copied by the scanner function of the scanner unit 30 and the printer function of the printer unit 20.

The recording apparatus 11 illustrated in FIG. 1 can perform printing on the medium M having a size of up to, for example, A3 size. Further, the recording apparatus 11 has a single-sided printing function of performing printing on only a single surface (a first surface) of the medium M and a double-sided printing function of performing printing on both surfaces (the first surface and a second surface) of the medium M. When the recording apparatus 11 is used for business, high-speed printing is required for both the single-sided printing and the double-sided printing. In the double-sided printing, since a reversing operation of reversing the medium M, of which the printing on the first surface has been completed, in a direction in which the printing on the second surface of which the front side and the rear side are reversed can be performed next time is involved, when a standby time of a next medium M occurs, a reduction in printing throughput is caused. The recording apparatus 11 according to the present embodiment performs the printing at a time of the double-sided printing at a high speed by eliminating or reducing a standby time of the following medium M during the reversing operation of the medium M.

Figure 2:
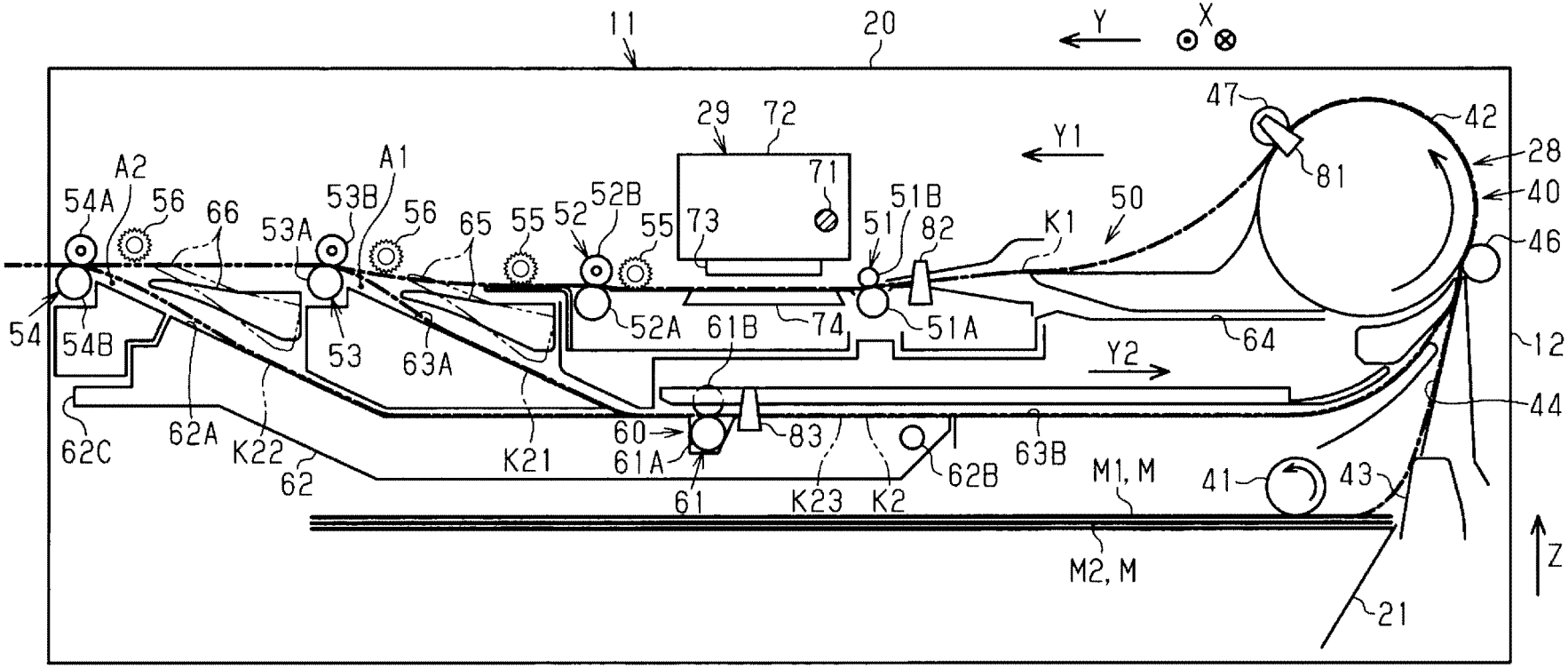
FIG. 2 is a schematic side sectional view illustrating a printer unit in the recording apparatus.

Next, the recording apparatus 11 will be described in detail with reference to FIG. 2. FIG. 2 is a schematic side sectional view illustrating the recording apparatus 11, the scanner unit 30 is omitted, and only one cassette 21 is illustrated. In the above description, a direction in which a recording unit 29 performs scanning to perform printing on the medium M is set as a scanning direction X, and a direction in which the medium M is transported at a position where the recording unit 29 performs the printing is set as a transport direction Y. In the present embodiment, the scanning direction X and the transport direction Y intersect each other, and both the directions intersect a vertical direction Z. The intersection means, for example, orthogonality.

As illustrated in FIG. 2, a plurality of the media M are accommodated in the cassette 21 of the recording apparatus 11. The casing 12 includes a transport mechanism 28 that transports the medium M and the recording unit 29 that performs recording on the medium M. The recording unit 29 of the present example performs the recording on the medium M by ejecting a liquid such as an ink.

The recording apparatus 11 has a first transport path K1 indicated by a thick dashed line in FIG. 2 and a second transport path K2 indicated by a thick two-dot chain line in the same figure as a transport path through which the transport mechanism 28 transports the medium M. The first transport path K1 is a path through the medium M is transported in a first direction Y1 by the recording unit 29 during the recording. The second transport path K2 is a path which is connected to the first transport path K1 at a position downstream of the recording unit 29 in the first direction Y1 and through which the medium M recorded by the recording unit 29 is transported to a path that is different from the first transport path K1 in a second direction Y2 that is different from the first direction Y1. The second transport path K2 is a path through which the medium M of which only the first surface transported through the first transport path K1 is recorded is switched back to a downstream side position of the first transport path K1 in the first direction Y1 during the double-sided printing, and then the medium M after the switchback is carried in from a distal end in the first direction Y1. The second transport path K2 is a reverse path for reversing the medium M of which the first surface has been completely recorded during the double-sided printing, and is joined to the first transport path K1 at an upstream position of the recording unit 29 in the first direction Y1. In the present embodiment, as illustrated in FIG. 2, the second transport path K2 is joined to the first transport path K1 at an intermediate position of a feeding path through which a feeding mechanism 40, which is an upstream position of the recording unit 29 in the first direction Y1, transports the medium M. After passing through the joint point, the medium M, which is transported along the second transport path K2 in the second direction Y2 and of which only the first surface is recorded, is reversed back and forth through the first transport path K1 and is re-fed to a recording area where the recording unit 29 performs the recording. In the case of the single-sided printing, the medium M, of which the printing on the first surface is performed by the recording unit 29, is discharged through the first transport path K1. However, even in the single-sided printing, in the case of face-down discharge described below, the medium M of which the printing on the first surface is performed is sent and reversed to the second transport path K2 by a switchback operation, and is then discharged through the first transport path K1 without printing while the first surface (a recorded surface) faces the lower side.

Next, a detailed configuration of the transport mechanism 28 that transports the medium M will be described. The transport mechanism 28 includes a feeding mechanism 40 that feeds the medium M, a first transport mechanism 50 that transports the medium M in an area including an area facing the recording unit 29 along the first transport path K1 in the first direction Y1, and a second transport mechanism 60 that transports the medium M along the second transport path K2 in the second direction Y2. Here, an area including an area facing the recording unit 29 denotes a recording area facing a scanning path of the recording unit 29.

The feeding mechanism 40 feeds the medium M in the cassette 21 one by one from the uppermost side. The first transport mechanism 50 performs a transport operation of transporting the medium M fed from the feeding mechanism 40 in a path passing through a recording area recorded by the recording unit 29, a discharge operation of discharging the medium M recorded by the recording unit 29, and a switchback operation of changing a transport path from the first transport path K1 to the second transport path K2 in order to reverse the medium M during the double-sided printing. Further, the second transport mechanism 60 transports the medium M, pulled into the second transport path K2 by the switchback operation and transported in the second direction Y2, along the second transport path K2 to a joint point between the first transport path K1 and the second transport path K2 in order to reverse the medium M. The medium M of which the printing on the first surface is performed during the double-sided printing is reversed while being transported along an outer circumference of the intermediate roller 42 via the second transport path K2 and is re-fed to the recording unit 29 through the first transport path K1.

As illustrated in FIG. 2, the feeding mechanism 40 includes a feeding roller 41 (a pickup roller) that feeds out an uppermost one among the medium M in the cassette 21 and an intermediate roller 42 that feeds the medium M fed out by the feeding roller 41 to the recording unit 29 that performs the recording (the printing), The feeding roller 41 rotates in an arrow direction to feed out the uppermost one among the medium M in the cassette 21 in the second direction Y2. A tip end of the fed-out medium M hits a separation wall 43 so that the fed-out medium M is separated from the following medium M. Only the separated one medium M is fed to the intermediate roller 42 located above a guide 44 along the guide 44.

The intermediate roller 42, which is a roller having a larger diameter than the other rollers, is in contact with a first roller 46 and a second roller 47 at two points on an outer circumferential surface of the intermediate roller 42. The medium M is nipped at two positions including a first nipping position where the intermediate roller 42 and the first roller 46 are in contact with each other and a second nipping position where the intermediate roller 42 and the second roller 47. As the intermediate roller 42 rotates in the arrow direction, the medium M nipped at the two positions of the rollers 46 and 47 is fed to a recording area facing the recording unit 29 along the first transport path K1. The feeding roller 41 and the intermediate roller 42 rotate by power of a feeding motor 101 illustrated in FIG. 5.

The first transport mechanism 50 includes a first transport roller pair 51, a first discharge roller pair 52, a second discharge roller pair 53, a third discharge roller pair 54, a plurality of floating rollers 55 and 56, and the like. A first transport roller pair 51 includes a driving roller 51A and a driven roller 51B. A first discharge roller pair 52 includes a driving roller 52A and a driven roller 52B. A second discharge roller pair 53 includes a driving roller 53A and a driven roller 53B. A third discharge roller pair 54 includes a driving roller 54A and a driven roller 54B.

Further, the second transport mechanism 60 includes a second transport roller pair 61. A second transport roller pair 61 includes a driving roller 61A and a driven roller 61B. The second transport roller pair 61 is disposed at a position close to the upper stream side in the second direction Y2 of the second transport path K2. An upstream side end portion of the second transport path K2 in the second direction Y2 is joined to a connecting position of the first transport path K1 on a downstream side of the recording unit 29 in the transport direction Y. The second transport path K2 has a first retraction path K21 formed by an inclined surface 63A where a portion extending from a first retraction port A1 located directly upstream of the second discharge roller pair 53 to a downstream side in the second direction Y2 obliquely descends. Further, the second transport path K2 has a common transport path K23 formed by a guide surface 63B that is a curved surface extending substantially transversely from a lower end portion of the first retraction path K21 and directed to the upper side at a portion close to a downstream side end portion in the second direction Y2. Further, a second retraction path K22 constituting the second transport path K2 has an inclined surface 62A where a portion extending from a second retraction port A2 located directly downstream of the third discharge roller pair 54 to a downstream side in the second direction Y2 obliquely descends, and is connected to the common transport path K23 extending substantially transversely from the vicinity of a lower end of the inclined surface 62A. That is, both the first retraction path K21 and the second retraction path K22 are joined to the common transport path K23. A guide member 62 forming a part of the inclined surface 62A and the guide surface 63B of the second transport path K2 is provided rotatably about a rotary shaft 62B, and the guide member 62 is pushed down by operating a gripping portion 62C at an end portion thereof. Thus, the second transport path K2 is exposed, and it is possible to eliminate the jam of the medium M occurring in the second transport path K2.

The second discharge roller pair 53 is configured to apply a transporting force to the medium M in the first direction Y1 and the second direction Y2 at a position downstream of the recording unit 29 in the first direction Y1. The third discharge roller pair 54 is configured to apply a transporting force to the medium M in the first direction Y1 and the second direction Y2 at a position downstream of the second discharge roller pair 53 in the first direction Y1. In the present embodiment, the roller pairs 53 and 54 that apply the transporting force to the medium M in the second direction Y2 are changed, so that a transport distance between a position of the recording unit 29 and a nipping position of a roller pair used for the switchback operation can be changed.

The recording apparatus 11 includes a first flap 65 that is disposed downstream of the recording unit 29 in the first direction Y1. The first flap 65 can be displaced between a first posture indicated by a solid line of FIG. 2 in which the first flap 65 is disposed upstream of the second discharge roller pair 53 in the first direction Y1 and is retracted from the first transport path K1 and a second posture indicated by a two-dot chain line of FIG. 2 in which the first flap 65 is advanced to the first transport path K1. Further, the recording apparatus 11 includes a second flap 66 disposed downstream of the first flap 65 in the first direction Y1. The second flap 66 can be displaced between a first posture indicated by a solid line of FIG. 2 in which the second flap 66 is disposed upstream of the third discharge roller pair 54 in the first direction Y1 and is retracted from the first transport path K1 and a second posture indicated by a two-dot chain line of FIG. 2 in which the second flap 66 is advanced to the first transport path K1. In FIG. 2, among the medium M, a preceding medium is designated by M1 and a following medium is designated by M2. Here, the preceding medium M1 denotes the medium previously fed from the cassette 21, and the following medium M2 denotes the medium fed from the cassette 21 next to the preceding medium M2.

Further, a first retraction port A1, for reversely transporting the medium M of which a rear end passes through the first flap 65 by reverse rotation of the second discharge roller pair 53 and drawing the medium M into the first retraction path K21 by guidance of the first flap 65, is disposed directly upstream of the second discharge roller pair 53 in the transport direction Y. Further, the second retraction port A2, for reversely transporting the medium M of which a rear end passes through the second flap 66 by reverse rotation of the third discharge roller pair 54 and drawing the medium M into the second retraction path K22 by guidance of the second flap 66 in the second posture, is disposed directly upstream of the third discharge roller pair 54 in the transport direction Y.

The second transport path K2 illustrated in FIG. 2 includes the first retraction path K21 in which the medium M guided to the first flap 65 by the reverse rotation of the second discharge roller pair 53 is pulled in from the first retraction port A1 and the second retraction path K22 in which the medium M guided to the second flap 66 in the second posture by the reverse rotation of the third discharge roller pair 54 is pulled in from the second retraction port A2. The nipping position of the second discharge roller pair 53 is set to a connecting position (a first connecting position) where the first retraction path K21 constituting the first transport path K1 and the second transport path K2 is connected to a downstream side of the recording unit 29 in the first direction Y1. Further, the nipping position of the third discharge roller pair 54 is set to a connecting position (a second connecting position) where the second retraction path K22 constituting the first transport path K1 and the second transport path K2 is connected to a downstream side of the nipping position of the second discharge roller pair 53 in the first direction Y1.

In the present embodiment, the two flaps 65 and 66 are rotatably disposed below the first transport path K1, and is advanced to the first transport path K1 from a rear surface opposite to a front surface recorded by the recording unit 29. The first flap 65 is disposed at a position where the first flap 65 supports the medium M1 transported along the first transport path K1 in the first posture such that the medium M1 faces the second discharge roller pair 53 and is disposed at a position where the medium M reversely transported by the switchback operation in the second posture is fed into the second transport path K2. Further, the second flap 66, when in the first posture, is disposed at a position where the second flap 66 supports the medium M1 transported along the first transport path K1 such that the medium M1 faces the third discharge roller pair 54, and when in the second posture, is disposed at a position where the medium M reversely transported by the switchback operation is fed into the second transport path K2. When the double-sided printing is performed on one sheet, the medium M may be reversed in a path passing through the first transport path K1 and a reverse passage 64 as a reverse path.

Further, as illustrated in FIG. 2, the recording apparatus 11 includes a first sensor 81 provided in the middle of the feed path in the first transport path K1, a second sensor 82 provided in the middle of the first transport path K1, and a third sensor 83 provided in the middle of the second transport path K2.

The recording unit 29 illustrated in FIG. 2, which uses a serial printing method, includes a carriage 72 that can reciprocate in the scanning direction X along a guide shaft 71 installed while extending in the scanning direction X intersecting the transport direction Y of the medium M in the casing 12. The carriage 72 has a recording head 73 formed at a lower portion thereof facing the first transport path K1 to eject an ink to the medium M. The carriage 72 moves in the scanning direction X, and the recording head 73 ejects the ink to the medium M during the movement, so that a letter and an image is recorded on the medium M. The recording head 73 is positioned on a downstream side of the first transport roller pair 51 in the transport direction Y and on an upstream side of the first discharge roller pair 52 in the transport direction Y. A support 74 for supporting the medium M is disposed at a position facing a movement path of the recording head 73 with the first transport path K1 interposed therebetween.

When the double-sided printing is instructed or when the single-sided printing is instructed in the face-down discharge in which the medium M of which a printed surface faces the lower side is discharged, the recording apparatus 11 switches back the medium M of which the printing on the first surface is terminated, draws the medium M into the second transport path K2, and reverses the medium M. Thus, the recording apparatus 11 circulates and transports the medium M along a circulation path formed by the first transport path K1 and the second transport path K2 to perform printing.

Figure 3:
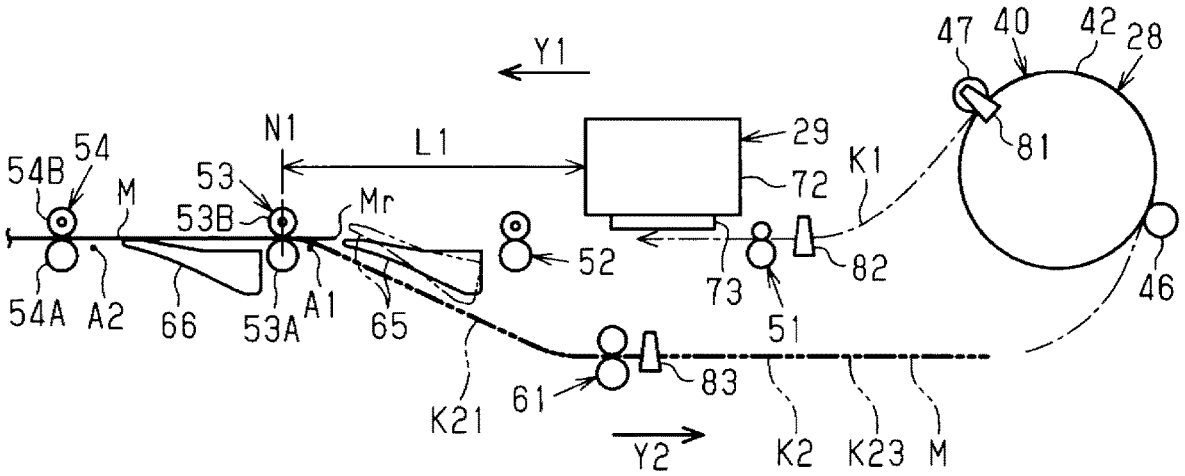
FIG. 3 is a schematic side sectional view for illustrating double-sided printing on one sheet in the recording apparatus.
Figure 4:
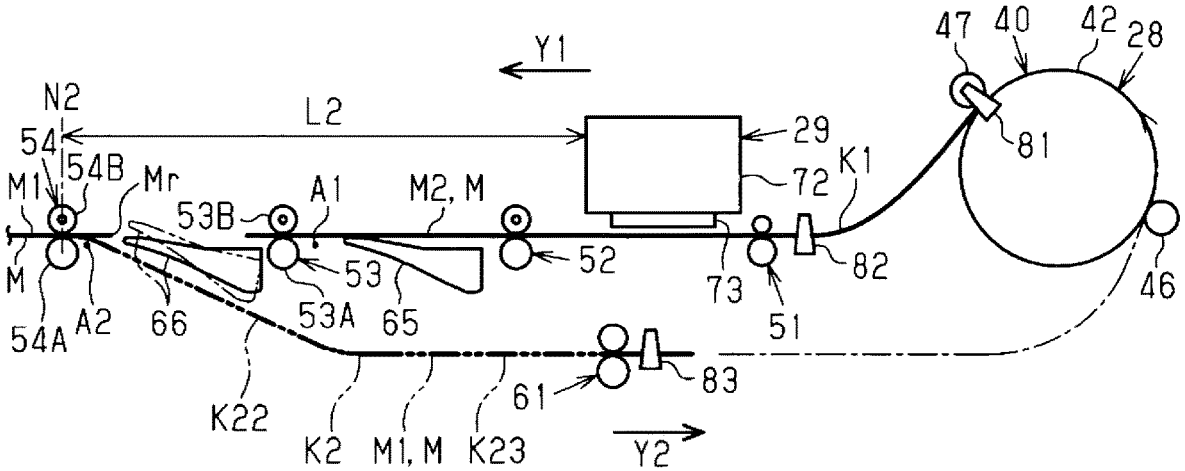
FIG. 4 is a schematic side sectional view for illustrating the double-sided printing on a plurality of sheets in the recording apparatus.

Next, the switchback operation for the double-sided printing on one sheet and the double-sided printing on a plurality of sheets will be described with reference to FIGS. 3 and 4. As illustrated in FIG. 3, during the double-sided printing on one sheet, the switchback operation is performed by the second discharge roller pair 53. Further, as illustrated in FIG. 4, during the double-sided printing on a plurality of sheets, the switchback operation is performed by the third discharge roller pair 54. In the recording apparatus 11, a transport distance between the position of the recording unit 29 and the connecting position where the first transport path K1 and the second transport path K2 are connected to each other can be changed. Here, the transport distance refers to a distance of the medium M along the transport path, and when a path of the medium M is changed, the transport distance is changed.

As illustrated in FIG. 3, the transport distance between the position of the recording unit 29 and the nipping position N1 of the second discharge roller pair 53 corresponding to the connecting position between the first transport path K1 and the first retraction path K21 constituting the second transport path K2 is set as a first transport distance L1. In the case of a printing condition in which the double-sided printing is performed on one sheet of the medium M, the medium M is drawn into the first retraction path K21 from the first retraction port A1.

Further, as illustrated in FIG. 4, the transport distance between the position of the recording unit 29 and the nipping position N2 of the third discharge roller pair 54 corresponding to the connecting position between the first transport path K1 and the second retraction path K22 constituting the second transport path K2 is set as a second transport distance L2 that is longer than the first transport distance L1. In the case of a printing condition in which the double-sided printing is performed on a plurality of media M, the medium M is drawn into the second retraction path K22 from the second retraction port A2 located downstream of the first retraction port A1 in the first direction Y1.

As illustrated in FIG. 3, the medium M drawn from the first retraction port A1 via the first retraction path K21 into the second transport path K2 is reversed at a path indicated by a one-dot chain line of the same drawing, which passes through an outer circumference of the intermediate roller 42 from the second transport path K2, and is then re-fed to an area facing the recording unit 29 along the first transport path K1.

Similarly, as illustrated in FIG. 4, the medium M drawn from the second retraction port A2 via the second retraction path K22 into the second transport path K2 is reversed at a path indicated by a one-dot chain line of the same drawing, which passes through an outer circumference of the intermediate roller 42 from the second transport path K2, and is then re-fed to an area facing the recording unit 29 along the first transport path K1. However, when the following medium M2 is being printed on the first transport path K1, and a rear end of the following medium M2 does not pass through a predetermined position in the outer circumference of the intermediate roller 42, the preceding medium M1 waits before the first nipping position. Thus, when the rear end of the following medium M2 passes through the predetermined position, the preceding medium M1 is transported and fed at a time of the printing of the following medium M2 while maintaining a predetermined interval between the preceding medium M1*l* and the following medium M2.

Figure 5:
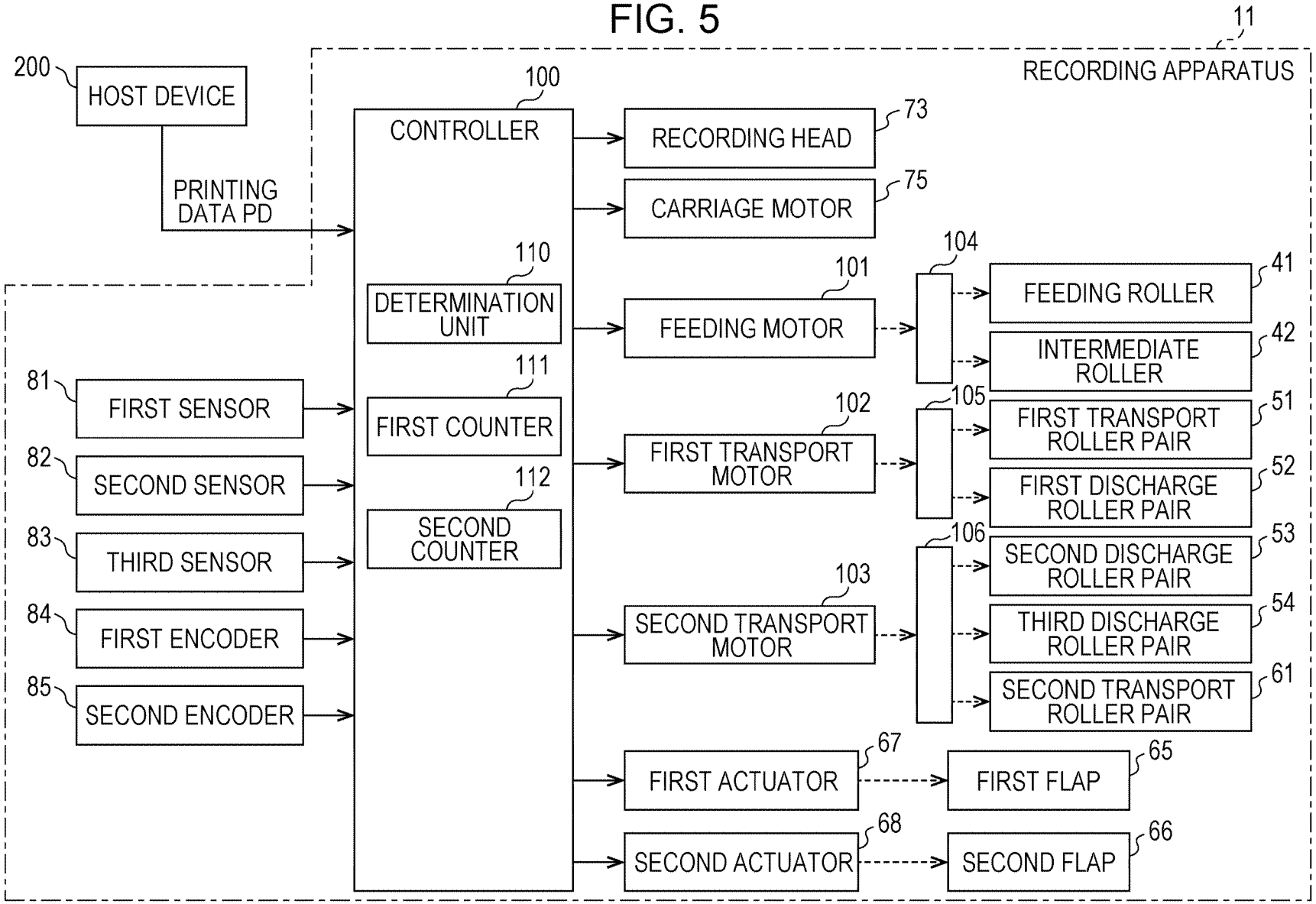
FIG. 5 is a block diagram illustrating an electric configuration of the recording apparatus.

Next, an electric configuration of the recording apparatus 11 will be described with reference to FIG. 5. In FIG. 5, the scanner unit 30 is omitted. As illustrated in FIG. 5, the recording apparatus 11 includes a controller 100. The controller 100 has a not-illustrated computer and a not-illustrated memory embedded therein, and the computer executes a program stored in the memory to perform various kinds of printing control. The recording apparatus 11 is wired or wirelessly communicably coupled to the host device 200. The controller 100 performs the printing control based on printing data PD received from the host device 200.

The printing data PD received from the host device 200 by the controller 100 includes printing condition information and printing image data. The controller 100 acquires information on the size of the medium (a medium size), the type of the medium (a medium type), whether or not the double-sided printing is performed, a color of the printing, printing quality, and the number of printed sheets, based on the printing condition information. Here, in whether or not the double-sided printing is performed, according to user's selection, when the double-sided printing is selected, the "double-sided printing" is instructed, and when the double-sided printing is not selected, the "single-sided printing" is instructed. One of the color and the gray scale selected by the user is indicated as the color of the printing. One of ordinary printing and high-definition printing selected by the user is instructed as the printing quality.

The first sensor 81, the second sensor 82, the third sensor 83, a first encoder 84, and a second encoder 85 are electrically coupled to an input terminal of the controller 100. The recording head 73, a carriage motor 75, the feeding motor 101, a first transport motor 102, the second transport motor 103, a first actuator 67, and a second actuator 68 are electrically coupled to an output terminal of the controller 100. The controller 100 is electrically coupled to the scanner unit 30 and controls a reading operation of the scanner unit 30.

Here, a relationship between rotation directions of the motor 101 to 103 and rotation directions of the roller pairs 51 to 54 and 61 will be described. The feeding motor 101 is coupled to the feeding roller 41 and the intermediate roller 42 through the gear mechanism 104 to enable power transmission. When the feeding motor 101 performs forward rotation driving, both rollers 41 and 42 perform forward rotation, and when the feeding motor 101 performs reverse rotation driving, the intermediate roller 42 performs forward rotation, and the feeding roller 41 is stopped. Accordingly, the feeding roller 41 rotates to feed the following medium M2 to a standby position before the first nipping position of the intermediate roller 42, and while the following medium M2 is kept in the standby position, the preceding medium M1*l* can be transported by rotating the intermediate roller 42.

The first transport motor 102 is coupled to the first transport roller pair 51 and the first discharge roller pair 52 through the gear mechanism 105 to enable power transmission. Each of the roller pairs 51 and 52 performs forward rotation when the first transport motor 102 performs forward rotation driving, to transport the medium M in the first direction Y1, and performs reverse rotation when the first transport motor 102 performs reverse rotation driving, to transport the medium M in the second direction Y2.

The second transport motor 103 is coupled to the second discharge roller pair 53, the third discharge roller pair 54, and the second transport roller pair 61 through the gear mechanism 106 to enable power transmission. The gear mechanism 106 is equipped with a not-illustrated clutch mechanism, and a position where the transport path is reversed by the clutch mechanism is changed between a first switching position and a second switching position. A lever that can change the clutch mechanism is provided on one end side (for example, a home position side) of a scanning path of the carriage 72, and as the carriage 72 pushes the level, the clutch mechanism of the gear mechanism 106 is changed between the first switching position and the second switching position. When the medium M of which the printing on the first surface is performed is drawn from the first retraction port A1 to the second transport path K2 under a printing condition in which the double-sided printing on one sheet of the medium M is performed, the clutch mechanism of the gear mechanism 106 is changed to the first switching position. When the medium M of which the printing on the first surface is performed is drawn from the second retraction port A2 to the second transport path K2 under a printing condition in which the double-sided printing on a plurality of the media M is performed, the clutch mechanism of the gear mechanism 106 is changed to the second switching position.

When the clutch mechanism of the gear mechanism 106 is changed to the first switching position, if the second transport motor 103 performs forward rotation driving, the second discharge roller pair 53 and the third discharge roller pair 54 perform forward rotation, so that the medium M is transported in the first direction Y1. Further, when the second transport motor 103 performs reverse rotation driving, the second discharge roller pair 53 and the third discharge roller pair 54 perform reverse rotation, so that the medium M is transported in the second direction Y2. Further, the second transport roller pair 61 performs the forward rotation when the second transport motor 103 performs the forward rotation driving, so that the medium M is transported in the second direction Y2, and is stopped when the second transport motor 103 performs reverse rotation driving, so that the medium M having been transported in the second direction Y2 stands by at a standby position on the second transport path K2, for example, before the first nipping position.

Further, when the clutch mechanism of the gear mechanism 106 is changed to the second switching position, if the second transport motor 103 performs forward rotation driving, the second discharge roller pair 53 and the third discharge roller pair 54 perform forward rotation, so that the medium M is transported in the first direction Y1. Further, when the second transport motor 103 performs reverse rotation driving, the second discharge roller pair 53 performs forward rotation, so that the medium M is transported in the first direction Y1, and the third discharge roller pair 54 performs the reverse rotation, so that the medium M is transported in the second direction Y2. Further, similar to the first switching position, even in the second switching position, the second transport roller pair 61 performs forward rotation when the second transport motor 103 performs the forward rotation driving or the reverse rotation driving, so that the medium M is transported in the second direction Y2. The third discharge roller pair 54 may be driven using a power source that is different from a power source of the second discharge roller pair 53. For example, the third discharge roller pair 54 and the second transport roller pair 61 may be driven using the same power source or the second discharge roller pair 53 may be driven using a separate power source.

Further, the first actuator 67 is coupled to the first flap 65 to enable power transmission. As the first actuator 67 is driven, the first flap 65 is disposed at the first posture in which the medium M can be supported and can be guided to the second discharge roller pair 53 as indicated by a solid line in FIG. 2 or the second posture in which the first flap 65 is advanced to the first transport path K1 as indicated by a two-dot chain line in FIG. 2. Further, the second actuator 68 is coupled to the second flap 66 to enable power transmission. As the second actuator 68 is driven, the second flap 66 is disposed at the first posture in which the second flap 66 can be supported and can be guided to the third discharge roller pair 54 as indicated by a solid line in FIG. 2 or the second posture in which the medium M is advanced to the first transport path K1 as indicated by a two-dot chain line in FIG. 2.

The first sensor 81 detects a tip end or a distal end of the medium M while the medium M is fed. In the present example, the first sensor 81 detects the tip end or the distal end of the medium M at the second nipping position on the outer circumference of the intermediate roller 42. The second sensor 82 detects positions of the tip end or the distal end of the medium M transported along the first transport path K1 at a predetermined position upstream of the recording unit 29 in the transport direction Y.

The third sensor 83 detects the positions of the tip end and the distal end of the medium M transported along the second transport path K2. The third sensor 83 on the second transport path K2 has a function of detecting whether or not the tip end of the medium M in the second direction Y2 is nipped by the second transport roller pair 61 and a function of detecting the medium M at a halfway position since a transport distance to the first sensor 81 to be detected next is long. A jam occurring in the middle of the second transport path K2 can be detected at an early stage by the latter function. That is, a case where even when a transport amount after detection by the third sensor 83 reaches a predetermined value, the medium M to be detected by the first sensor 81 is not detected is detected as the jam.

Further, as illustrated in FIG. 5, the controller 100 includes a determination unit 110, a first counter 111, and a second counter 112. The determination unit 110 determines a retraction port required during the switchback operation among the two retraction ports A1 and A2 according to conditions such as the single-sided printing or the double-sided printing, the length of the medium, whether or not there is the following medium, and the single-sided printing in the face-down discharge. That is, the determination unit 110 determines a discharge roller pair used for the switchback operation of the medium M among the two discharge roller pairs 53 and 54.

The determination unit 110 determines a retraction port through which the medium M is drawn into the second transport path K2 during the switchback operation among the two retraction ports A1 and A2. That is, the determination unit 110 determines the discharge roller pair used for the switchback operation of the medium M among the two discharge roller pairs 53 and 54. The controller 100 includes a not-illustrated CPU and a not-illustrated memory. A program illustrated in a flowchart of FIG. 6, which the CPU stores in the memory, is executed, so that the transport control including the determination processing by the determination unit 110 is performed. Hereinafter, a determination process performed using the determination unit 110 by the controller 100 will be described with reference to FIG. 6. The controller 100 performs the determination processing based on the printing data PD. The determination processing is performed based on the printing condition information included in the printing data PD, such as the single-sided printing or the double-sided printing, the length of the medium, whether or not there is the following medium, and the single-sided printing in the face-down discharge. Hereinafter, in the case of the double-sided printing, an example of a method of determining a discharge roller using a switchback operation will be described. However, in the case of the face-down discharge also in the single-sided printing, a discharge roller used for the switchback operation will be determined using determination processing which is nearly the same as the determining processing of the double-sided printing. In this case, in the following processing, the same process is performed merely by replacing the double-sided printing with the single-sided printing in the face-down.

First, in step S11, the controller 100 determines whether or not the double-sided printing is performed. When it is determined that the double-sided printing is performed, the process proceeds to step S12, and when it is determined that the double-sided printing is not performed, the routine is terminated.

In step S12, the controller 100 determines whether or not the double-sided printing is performed on a plurality of sheets. When the double-sided printing is performed on a plurality of sheets, the process proceeds to step S14. Further, when the double-sided printing is performed on the plurality of sheets, the process proceeds to step S13.

In step S13, the controller 100 sets a one-sheet circulation transport method. That is, when the double-sided printing on one sheet is instructed, the one-sheet circulation transport method is set in which one medium M is circulated and transported along the circulation path formed by the transport paths K1 and K2 with the switchback operation of the medium M so that the double-sided printing is performed. Here, when the double-sided printing on one sheet is performed, since there is no following medium M2 and there is no concern that the printing on the following medium M2 is hindered when the medium M is switched back, it is preferable that the medium M is switched back at a position close to the position of the recording unit 29. Therefore, in the case of the one-sheet circulation transport method, the process proceeds to step S17, and the controller 100 determines a retraction port at a time of the switchback operation as the first retraction port A1. That is, the controller 100 determines the second discharge roller pair 53 as the discharge roller pair to be used for the switchback operation.

Meanwhile, in step S14, the controller 100 sets the two-sheet circulation transport method. That is, when the double-sided printing on a plurality of sheets is instructed, the determination unit 110 sets the two-sheet circulation transport method in which the preceding medium M1 and the following medium M2 are circulated and transported along the circulation path formed by the transport paths K1 and K2 with the switchback operation so that the double-sided printing on two sheets is performed in parallel.

In step S15, the controller 100 determines whether or not the length of the medium is equal to or more than a predetermined length. That is, when the two-sheet circulation transport method is set, the controller 100 determines a switchback operation in which the medium M is drawn from the first retraction port A1 to the second transport path K2 or a switchback operation in which the medium M is drawn from the second retraction port A2, based on the printing condition information. In the processing of step S15, for example, it is determined whether the length of the medium, which is the length of the medium M in the transport direction Y, is the size of the medium, which is equal to or more than a predetermined length equal to a path length of the second transport path K2, through the first retraction path K21. When the length of the medium is equal to or more than the predetermined length, the process proceeds to step S18, and the controller 100 determines a retraction port at a time of the switchback operation as the second retraction port A2. That is, the controller 100 determines the discharge roller pair to be used for the switchback operation as the third discharge roller pair 54. Accordingly, the switchback operation is performed in which the third discharge roller pair 54 is reversed and the medium M is drawn from the second retraction port A2, and after the switchback operation, the medium M is accommodated in the second transport path K2.

By the way, even in the double-sided printing on a plurality of sheets in which the length of the medium M is equal to or less than the predetermined length, when a printing speed of the following medium M2 is a high speed that exceeds a threshold, the preceding medium M1 during the switchback operation hinders the transport of the following medium M2 during the printing. In the switchback operation of the preceding medium M1, the forward rotation of the second discharge roller pair 53 is changed to the reverse rotation. Therefore, until the switchback operation of the preceding medium M1 is terminated, the following medium M2 cannot be introduced into the second discharge roller pair 53. After a tip end of the preceding medium M1 in the transport direction Y passes through the nipping position N1 of the second discharge roller pair 53 in the second direction Y2, until the tip end of the following medium M2 can be introduced into the second discharge roller pair 53, a standby time is required in which the printing on the following medium M2 is stopped temporarily.

In step S16, when it is assumed that the switchback operation is performed using the second discharge roller pair 53, the controller 100 determines whether or not a wait time is generated in the printing of the following medium M2 due to the switchback operation of the preceding medium M1. Whether or not the wait time is required in the printing of the following medium M2 is determined based on a printable length and a printing speed of the following medium M2 until the tip end of the following medium M2 in the first direction Y1 reaches the nipping position of the discharge roller pair used for the switchback operation of the preceding medium M1. The printing speed is determined based on contents of a printing pattern and contents of the printing quality.

In detail, the controller 100 analyzes the printing pattern based on printing image data included in the printing data PD, acquires the printing speed according to the printing quality, and determines whether or not a wait time is generated based on the printing pattern and the printing speed. In the present embodiment, the transport distances L1 and L2 from the position of the recording unit 29 to the nipping positions N1 and N2 of the two discharge roller pairs 53 and 54 are known. The controller 100 predicts a termination time of the switchback operation of the preceding medium M1 based on information such as the printing pattern and the discharge speed, and predicts the printable length of the following medium M2 based on the position of the recording unit 29 at the predicted termination time of the switchback operation. Further, the controller 100 compares a printable length Lp of the following medium M2 with the first transport distance L1 and the second transport distance L2. When $Lp+\alpha<L1$ is satisfied, the controller 100 determines that the wait time of the following medium M2 is not generated. Further, when $L1\leq Lp+\alpha<L2$ is satisfied, the controller 100 determines that the wait time is generated. The controller 100 proceeds to step S17 when the wait time is not generated, and proceeds to step S18 when the wait time is generated.

In step S17, the controller 100 determines a retraction port at a time of the switchback operation as the first retraction port A1. That is, the controller 100 determines the second discharge roller pair 53 that can ensure the first transport distance L1 as the discharge roller pair used for the switchback operation. The medium M switched back using the second discharge roller pair 53 is drawn from the first retraction port A1, so that the wait time of the following medium M2 is not generated, and a reverse path of the preceding medium M1 is shortened.

Further, in step S18, the controller 100 determines the second retraction port A2. That is, the controller 100 determines the third discharge roller pair 54 that can ensure the second transport distance L2 as the discharge roller pair used for the switchback operation. The medium M switched back using the third discharge roller pair 54 disposed downstream of the second discharge roller pair 53 in the transport direction Y is drawn from the second retraction port A2, so that the length of the reverse path of the preceding medium M1 becomes somewhat longer, and the wait time of the following medium M2 is not generated. The value a is a margin value considering a variation in a transport position of the medium M. Further, when a retraction port of the preceding medium M1 is determined as the second retraction port A2, a time taken until the switchback operation and the reverse operation are terminated becomes longer by an amount corresponding to the length of a reverse path of the preceding medium M1. Thus, in order to shorten the taken time, a relatively short wait time may be set in the printing of the following medium M2.

Figure 6:
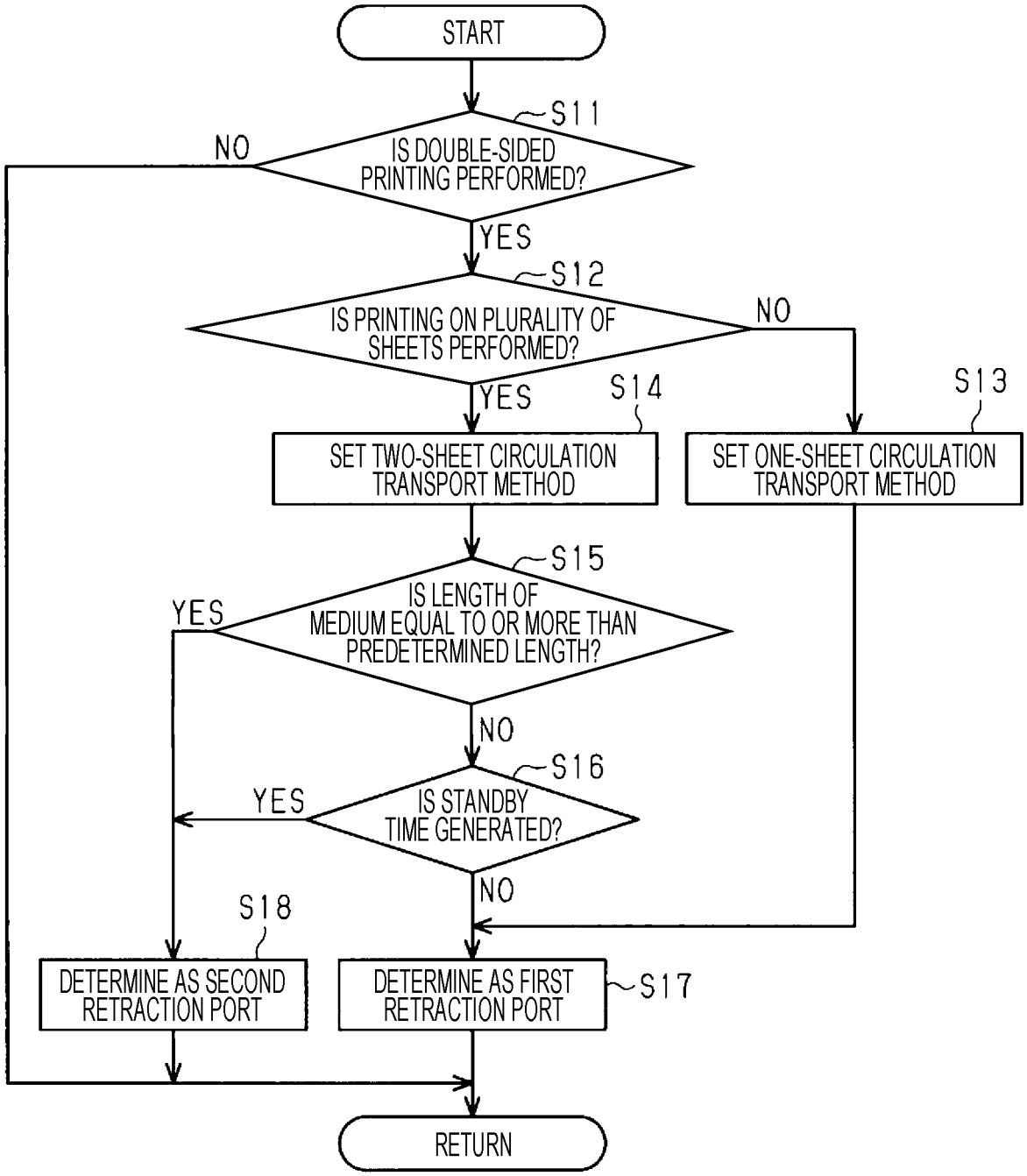
FIG. 6 is a flowchart illustrating determination processing.

Further, when the face-down discharge for the single-sided printing is instructed, the "double-sided printing" in step S11 of FIG. 6 is replaced with the "face-down discharge for the single-sided printing", and processing of steps S12 to S18 is similarly performed. When the size of the medium exceeds a predetermined size or when printing on only one sheet is performed, the one-sheet circulation transport method is set. Meanwhile, even when the face-down discharge for the single-sided printing is instructed, when the printing on a plurality of sheets having a medium size that is equal to or less than the predetermined size is performed, the two-sheet circulation transport method is set. When the single-sided printing on a plurality of sheets in the face-down discharge is performed, similarly to the double-sided printing on a plurality of sheets, the controller 100 determines whether $Lp+\alpha<L1$ is satisfied or whether $L1\leq Lp+\alpha<L2$ is satisfied, and determines the discharge roller pair used for the switchback operation among the two discharge roller pairs 53 and 54, based on a result of the determination. In the single-sided printing in the face-down discharge, printing is performed on only the first surface of the medium M, and the medium M is reversed back and forth after the printing on the first surface and is discharged while the printed surface is directed to the lower side. In this way, as the controller 100 executes a program, the determination unit 110 performs a determination process of determining a retraction port used for the switchback operation, that is, the discharge roller pair.

When the one-sheet circulation transport method is set in the double-sided printing or the single-sided printing in the face-down discharge, the controller 100 can change a second reverse path passing through the second transport path K2 to a first reverse path passing through the reverse passage 64 by pulling back the first transport path K1. In the present embodiment, when the one-sheet circulation transport method is set, the controller 100 determines whether a reverse path is the first reverse path passing through the reverse passage 64 by pulling back the first transport path K1 or the second reverse path passing through the second transport path K2, based on an ejection amount (a discharge amount) of the ink ejected to the medium M, and changes the reverse path according to the ejection amount of the ink. Here, when the ejection amount of the ink according to the medium M exceeds the threshold, there is concern that the medium M is easily curled, and the medium M rubs against a nozzle opening surface of the recording head 73 while returning to the first transport path K1. When the medium M rubs against the recording head 73, the recording head 73 rubs against the printed surface, the printing quality deteriorates, and a damage to the recording head 73, which cannot properly eject an ink from a nozzle, occurs. Therefore, the determination unit 110 selects the first reverse path if the ejection amount of the ink is equal to or less than a threshold when the one-sheet circulation transport method is set, and selects the second reverse path when the ejection amount of the ink exceeds the threshold. Since the first reverse path has a reverse path length that is shorter than the second reverse path, the reverse operation of the medium M is early terminated. Throughput in the double-sided printing or the single-sided printing in the face-down discharge performed by the one-sheet circulation transport method is improved.

The controller 100 determines the discharge roller pair used for the switchback operation among the discharge roller pairs 53 and 54 based on a result of the determination by the determination unit 110. However, the standby time may be required in which the printing on the following medium M2 is stopped temporarily. For example, since the standby time of the following medium M2 calculated by the controller 100 is merely a predicted value, even when control to eliminate the standby time of the predicted value is performed, the short standby time may be generated actually. Further, due to values of the transport distances L1 and L2, even when the switchback operation is performed using the third discharge roller pair 54 that can secure the second transport distance L2, the standby time is reduced. However, the standby time is not resolved. In this case, until the switchback operation of the preceding medium M1 from the first transport path K1 to the second transport path K2 is terminated and the rear end of the preceding medium M1 in the second direction Y2 completely passes through the discharge roller pairs 53 and 54, the controller 100 causes the following medium M2 to wait in a state in which the tip end of the following medium M2 is located at the standby position before the discharge roller pairs 53 and 54. The standby time is set to a predetermined position before the flaps 65 and 66 or is set to a predetermined position on the flaps 65 and 66. The standby position of the following medium M2 is set to a position slightly farther upstream in the transport direction Y from the nipping position of the discharge roller pairs 53 and 54 used for the switchback operation. This is because the tip end of the following medium M2 is guided to the upper side by the flaps 65 and 66 in the second posture during the switchback operation, and failure of guidance of the following medium M2 to the discharge roller pairs 53 and 54 is avoided.

The controller 100 grasps the position of the medium M on the transport paths K1 and K2 during the transport, based on a result of the detection by the sensors 81 to 83. The controller 100 counts, by a not-illustrated counter, the number of pulse edges of a pulse signal input from a not-illustrated encoder that detects rotation of the feeding motor 101 after the first sensor 81 detects the tip end or the rear end of the medium M being fed, and thus grasps a position of the tip end or the rear end of the medium M on the feeding path based on the counted value.

Further, the first counter 111 counts the number of pulse edges of a pulse signal from the first encoder 84 after the second sensor 82 detects the tip end of the medium M transported through the first transport path K1. The controller 100 grasps the position of the tip end of the medium M mainly on the first transport path K1 based on the counted value of the first counter 111. Further, the first counter 111 counts the number of pulse edges of the pulse signal from the first encoder 84 after the second sensor 82 detects the rear end of the medium M. The controller 100 grasps a position of the rear end of the medium M mainly on the first transport path K1 based on the counted value of the first counter 111.

Further, the second counter 112 counts the number of pulse edges of the pulse signal from the second encoder 85 after the third sensor 83 detects the rear end of the medium M. The controller 100 grasps the position of the tip end of the medium M mainly on the second transport path K2 based on the counted value of the second counter 112. Further, the second counter 112 counts the number of pulse edges of the pulse signal from the second encoder 85 after the third sensor 83 detects the rear end of the medium M. The controller 100 grasps a position of the rear end of the medium M mainly on the second transport path K2 based on the counted value of the second counter 112.

Further, the counted value of the second counter 112 is used for keeping the medium M on standby before the first nipping position between the intermediate roller 42 and the first roller 46. When the tip end of the medium M reaches the standby position before the first nipping position, the controller 100 causes the second transport motor 103 to perform reverse rotation driving. Accordingly, until the rear end of the medium M passes through a predetermined position on an outer peripheral surface of the intermediate roller 42 while the medium M on the first transport path K1 is transported by the forward rotation of the second discharge roller pair 53, it is possible to cause the medium M on the second transport path K2 to stand by at the standby position before the first nipping position.

That is, the controller 100 changes a mode to a switchback operation in which the medium M is drawn from the first retraction port A1 to the second transport path K2 or a switchback operation in which the medium M is drawn from the second retraction port A2 to the second transport path K2, according to whether the double-sided printing on one sheet or the double-sided printing on a plurality of sheets is performed.

Next, an operation of the recording apparatus 11 will be described. The controller 100 receives the printing data PD from the host device 200. The printing data PD includes printing condition information and printing image data. The controller 100 acquires information on the size of the medium (a medium size), the type of the medium (a medium type), whether or not to perform the double-sided printing (the double-sided printing or the single-sided printing), a color of the printing (a color or a gray scale), printing quality (normal printing or high definition printing), and the number of printed sheets, based on the printing condition information. When the medium M is A3 format exceeding a predetermined size, the controller 100 sets the one-sheet circulation transport path in which the double-sided printing is performed one by one in the double-sided printing on a plurality of sheets. Further, when the one-sheet circulation transport method is set, the determination unit 110 selects one of the first reverse path for returning the first transport path K1 and the second reverse path passing through the second transport path K2, based on the ejection amount of the ink, measured based on the printing image data.

Meanwhile, when the double-sided printing on a plurality of sheets using the medium M corresponding to A4 format or less, which is equal to or less than a predetermined size, is instructed, the controller 100 sets the two-sheet circulation transport method. Further, when the two-sheet circulation transport method is set, one of the two discharge roller pairs 53 and 54 is selected as a discharge roller pair used for the switchback operation, based on a result of the determination based on the printing condition information and analysis information of the printing image data by the determination unit 110.

First, an operation when the recording apparatus 11 is instructed to perform the double-sided printing on one sheet will be described with reference to FIG. 3. Hereinafter, a case where a reverse operation through the second transport path K2 is performed will be described as an example. As illustrated in FIG. 2, in a stage before the printing starts, the two flaps 65 and 66 are disposed at the first posture where the medium M retracted to the lower side along the first transport path K1 can be guided toward the second discharge roller pair 53 along the first transport path K1. The feeding roller 41 performs forward rotation driving from a state illustrated in FIG. 2, so that the preceding medium M1 is fed from the cassette 21 in a feeding direction, and the fed preceding medium M1 is fed along an outer periphery of the intermediate roller 42, and is then nipped to the first transport roller pair 51 performing forward rotation in the first direction Y1.

During printing, for example, the medium M is nipped by the first transport roller pair 51 and the first discharge roller pair 52 at two positions. During the printing, as a recording operation in which while the carriage 72 moves once in the scanning direction X, the recording head 73 performs recording on the preceding medium M1 by one scanning and one-time transport operation in which the preceding medium M1 is transported to a next recording position are alternately performed, the printing is performed on the preceding medium M1 by the recording unit 29. When the printing on the first surface is completed, the medium M is discharged until the rear end of the medium M passes through the first flap 65. Next, the first transport motor 102 performs the reverse rotation driving, so that the medium M is drawn from the first retraction port A1 to the second transport path K2. After the medium M passing through the second transport path K2 is reversed through the intermediate roller 42, the medium M is re-fed. Thus, the printing on the second surface (the rear surface) of the medium M is performed. The medium M on which the double-sided printing is completed is discharged.

In this way, since the medium on which the printing is completed by the recording unit 29 is drawn from the first retraction port A1 on a downstream side by the first transport distance L1 from the position of the recording unit 29, the transport distance accompanied by the reversal until the printing on the second surface of the medium M is started can be shortened, and the printing on the second surface can be started early. Therefore, the double-sided printing on one sheet can be performed at a high speed.

Next, the double-sided printing on a plurality of sheets will be described with reference to FIG. 4. The recording unit 29 performs printing on the first surface of the preceding medium M1 fed from the cassette 21 and transported along the first transport path K1. As a recording operation in which while the carriage 72 moves once in the scanning direction X, the recording head 73 performs recording on the preceding medium M1 by one scanning and a transport operation in which the preceding medium M1 is transported to a next recording position are alternately performed, the printing is performed on the first surface of the preceding medium M1 by the recording unit 29. When the rear end of the preceding medium M1*l* reaches a predetermined position in the middle of the intermediate roller 42, the feeding roller 41 performs forward rotation driving, and feeding of the following medium M2 is started.

Until the rear end of the preceding medium M1 of which the printing on the first surface is completed passes through the second flap 66, the preceding medium M1 is transported in the first direction Y1. When the rear end Mr of the preceding medium M1 passes through the second flap 66, the second flap 66 moves from the first posture indicated by a solid line of FIGS. 2 and 4 to the second posture indicated by a two-dot chain line of the same drawings. As the forward rotation of the third discharge roller pair 54 is changed to the reverse rotation, the preceding medium M1 is guided by the flap 66 disposed in the second posture and is drawn into the second transport path K2. The second transport distance L2 that is longer than the first transport distance L1 is secured as the transport distance between the position of the recording unit 29 and the nipping position of the third discharge roller pair 54 corresponding to the connecting position between the first transport path K1 and the second retraction path K22. Therefore, while the preceding medium M1 is switched back, a long transport distance by which the printing on the first surface of the following medium M2 can continue can be secured.

Similarly, when the printing on the first surface of the following medium M2 is performed and the printing on the first surface is completed, the following medium M2 is discharged in the first direction Y1 until the rear end of the following medium M2 passes through the second flap 66. When the rear end of the following medium M2 passes through the second flap 66, the second flap 66 moves from the first posture indicated by the solid line of FIGS. 2 and 4 to the second posture indicated by the two-dot chain line of the same drawings. As the forward rotation of the third discharge roller pair 54 is changed to the reverse rotation, the following medium M2 is switched back, is guided by the flap 66 disposed in the second posture, and is drawn into the second transport path K2. The second transport distance L2 that is longer than the first transport distance L1 is secured as the transport distance between the position of the recording unit 29 and the nipping position N2 of the third discharge roller pair 54 corresponding to the connecting position between the first transport path K1 and the second retraction path K22. Therefore, a long printable length by which the printing on the second surface of the preceding medium M1 can continue can be secured as a result, while the following medium M2 is switched back, the printing on the second surface of the preceding medium M1 can continue.

Further, when the printing on the second surface of the preceding medium M1 is completed, the discharge roller pairs 52 to 54 perform the forward rotation driving, and the preceding medium M1 is discharged in the first direction Y1 while being nipped by both the discharge roller pairs 52 and 53. In this case, since the preceding medium M1 is discharged without being switched back, the printing on the second surface of the following medium M2 can continue. Thus, during the printing on the second surface of the following medium M2, feeding of the preceding medium M1 that is a target of the next two-sheet circulation transport is started. Hereinafter, similarly, the double-sided printing on the medium M is progressed by the two-sheet circulation transport method.

Further, even when the single-sided printing in the face-down discharge is instructed, the medium M is circulated and transported through the two transport paths K1 and K2, which is like the double-sided printing. That is, when the single-sided printing on one sheet in the face-down discharge is instructed, the one-sheet circulation transport method is set, and feeding, printing, reversing, and discharging of one medium M are performed. At this time, the medium M switched back by reverse rotation of the second discharge roller pair 53 located at a position where the first transport distance L1 can be secured is fed from the first retraction port A1 to the second transport path K2. Meanwhile, when the single-sided printing on a plurality of sheets in the face-down discharge is instructed, the two-sheet circulation transport method is set, and the preceding medium M1 and the following medium M2 are circulated and transported through the two transport paths K1 and K2. At this time, the preceding medium M1 switched back by reverse rotation of the third discharge roller pair 54 located at a position where the second transport distance L2 can be secured is fed from the second retraction port A2 to the second transport path K2. During the two-sheet circulation transport, the printing on the first surface and the reversing of each the preceding medium M1 and the following medium M2 are progressed at the same time. Therefore, the double-sided printing on a plurality of sheet in the face-down discharge can be performed at a high speed.

According to the above-described embodiment, the following effects can be obtained.

(1) The recording apparatus 11 includes the recording unit 29 that performs recording on the recording medium M. Further, the recording apparatus 11 includes the first transport path K1 through which the recording medium M is transported in the first direction Y1 by the recording unit 29 during the recording and the second transport path K2 which is connected to the first transport path K1 at a downstream position of the recording unit 29 in the first direction Y1 and through which the recording medium M recorded by the recording unit 29 is transported along a path that is different from the first transport path K1 in the second direction Y2 that is different from the first direction Y1. The transport distance between the position of the recording unit 29 and the connecting position where the first transport path K1 and the second transport path K2 are connected to each other can be changed. Thus, since the transport distance between the position of the recording unit 29 and the connecting position where the first transport path K1 and the second transport path K2 are connected to each other can be changed, in the case of the double-sided printing on one sheet, the transport distance from the position of the recording unit 29 is set as the first transport distance L1. In the case of the double-sided printing on a plurality of sheets, the transport distance from the position of the recording unit 29 to the connecting position is changed to the second transport distance L2 that is longer than the first transport distance L1. Accordingly, throughput of printing in both the double-sided printing on one sheet and the double-sided printing on a plurality of sheets can be improved. Further, when the single-sided printing is performed in the face-down discharge, throughput of printing in both the single-sided printing on one sheet and the single-sided printing on a plurality of sheets can be improved. For example, during printing on a plurality of sheets, even when the standby time is required in which the printing on the following medium M2 is temporarily stopped during the switchback operation of the preceding medium M1, since the standby time can be shortened, printing unevenness caused by the temporary stopping can be reduced.

(2) A plurality of discharge roller pairs 53 and 54 that can apply a transporting force to the recording medium M in the first direction Y1 or the second direction Y2 are included at a downstream position of the recording unit 29 in the first direction Y1. The transport distance can be changed by changing the discharge roller pairs 53 and 54 that apply the transporting force to the recording medium M in the second direction Y2. Thus, the transport distance is changed by changing the discharge roller pairs 53 and 54 that apply a transporting force to the recording medium M in the second direction Y2 among the plurality of discharge roller pairs 53 and 54 that can apply a transporting force to the recording medium M in the first direction Y1 and the second direction Y2 at the downstream position of the recording unit 29 in the first direction Y1. In the double-sided printing on one sheet, the medium M is transported in the second direction Y2 by the discharge roller pairs 53 and 54 of which the transport distance is the first transport distance L1 among the plurality of discharge roller pairs 53 and 54. Further, during the double-sided printing on a plurality of sheets, the medium M is transported in the second direction Y2 by the discharge roller pairs 53 and 54 of which the transport distance is the second transport distance L2 that is longer than the first transport distance L1 among the plurality of discharge roller pairs 53 and 54. Thus, throughput of printing in both the double-sided printing on one sheet and the double-sided printing on a plurality of sheets can be improved.

(3) The recording apparatus 11 includes a first transport mechanism 50 that transports the recording medium M in an area including an area facing the recording unit 29 on the first transport path K1 in the first direction Y1 and a second transport mechanism 60 that transports the recording medium M along the second transport path K2 in the second direction Y2. Thus, the medium M can be transported along the first transport path in the first direction Y1 by the first transport mechanism, and the medium M can be transported along the second transport path in the second direction Y2 by the second transport mechanism.

(4) The second transport path K2 is a reverse path that is joined to the first transport path K1 at an upstream position of the recording unit 29 in the first direction Y1. Thus, the double-sided printing can be performed in which the medium M transported through the second transport path K2 after recording is performed on a single surface of the medium M is fed from a joint point to the first transport path K1, is reversed, and is re-fed, so that recording is performed on a second surface that is opposite to the recorded first surface of the medium.

(5) The recording apparatus 11 includes the first transport mechanism 50 that transports the medium M in an area including an area facing the recording unit 29 on the first transport path K1 in the first direction Y1 and the second transport mechanism 60 that transports the medium M along the second transport path K2 in the second direction Y2. Thus, the medium M can be transported along the first transport path K1 in the first direction Y1 by the first transport mechanism 50, and the medium M can be transported along the second transport path K2 in the second direction Y2 by the second transport mechanism 60.

Second Embodiment

Next, a second embodiment will be described with reference to FIGS. 7 to 10. The recording apparatus 11 according to the second embodiment is not provided with the third discharge roller pair 54, and the second discharge roller pair 53 as an example of a roller pair is movable. As the second discharge roller pair 53 moves, the transport distance is variable. Description of a configuration that is common to the configuration according to the first embodiment will be omitted, and only particularly different configurations will be described.

Figure 7:
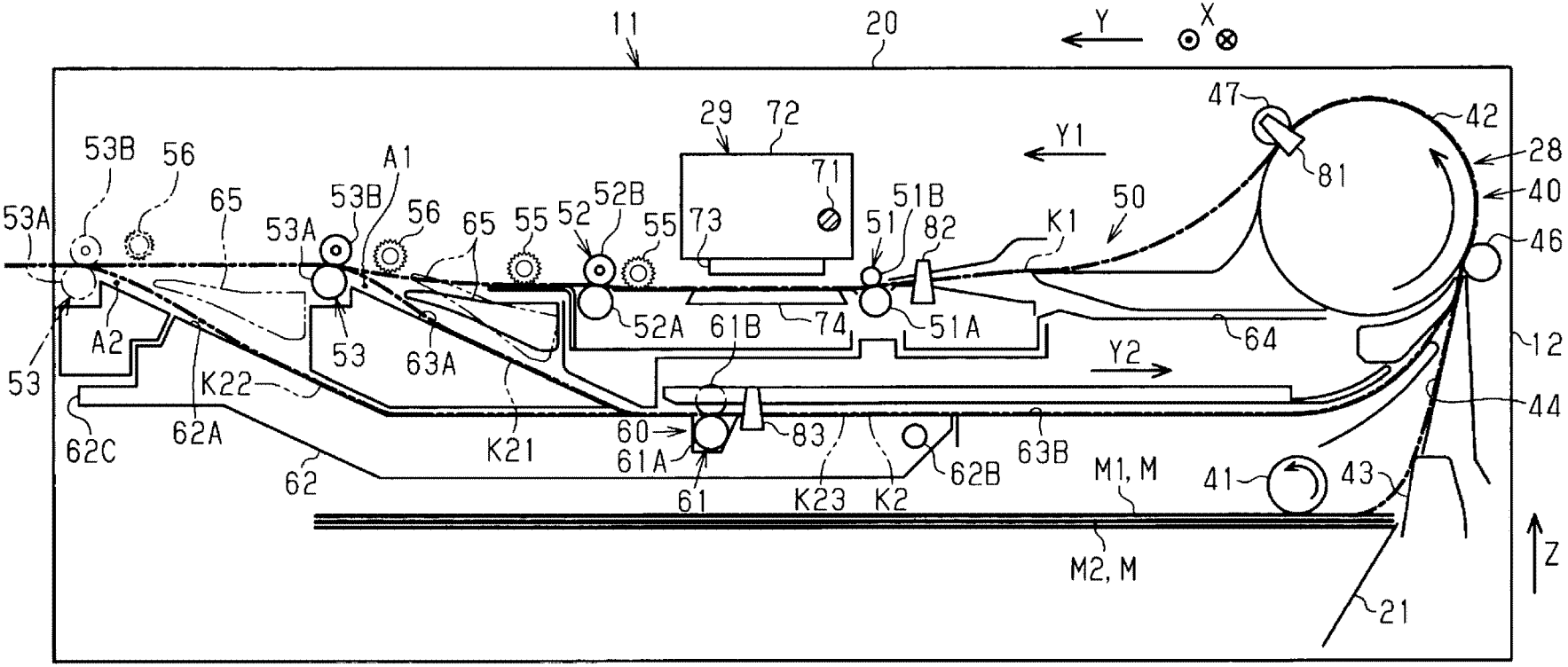
FIG. 7 is a schematic side sectional view for illustrating a recording apparatus according to a second embodiment.

In the recording apparatus 11 illustrated in FIG. 7, the transport distance between the position of the recording unit 29 and the connecting position where the first transport path K1 and the second transport path K2 are connected to each other can be changed. The recording apparatus 11 includes the second discharge roller pair 53 as an example of a roller pair, which can apply a transporting force in the first direction Y1 and the second direction Y2 to the medium M at a downstream position of the recording unit 29 in the first direction Y1. In the present embodiment, the nipping position of the second discharge roller pair 53 is the connecting position where the first transport path K1 and the second transport path K2 are connected to each other, and the transport distance can be changed by changing the position of the second discharge roller pair 53.

As illustrated in FIG. 7, the second discharge roller pair 53 can change a position thereof along the transport direction Y of the medium M. Further, the flap 65 located directly upstream of the second discharge roller pair 53 in the transport direction Y can move along the transport direction Y together with the second discharge roller pair 53 while a position relationship between the flap 65 and the second discharge roller pair 53 is maintained. That is, the second discharge roller pair 53 and the flap 65 can move along the transport direction Y between a first position indicated by a solid line of FIG. 7 and a second position indicated by a two-dot chain line, located downstream of the first position in the transport direction Y. In FIG. 7, as indicated by the flap 65 disposed at the first position, similarly to the first embodiment, the flap 65 can pivot between a first posture indicated by a solid line of FIG. 7 in which the flap 65 is retracted with respect to the first transport path K1 to support the medium M so as to be guidable to the second discharge roller pair 53 and a second posture in which the flap 65 is advanced further from the first posture with respect to the first transport path K1. In the present embodiment, a floating roller 56 provided for guiding the medium M to the second discharge roller pair 53 can also move in the transport direction Y together with the second discharge roller pair 53 and the flap 65.

Figure 8:
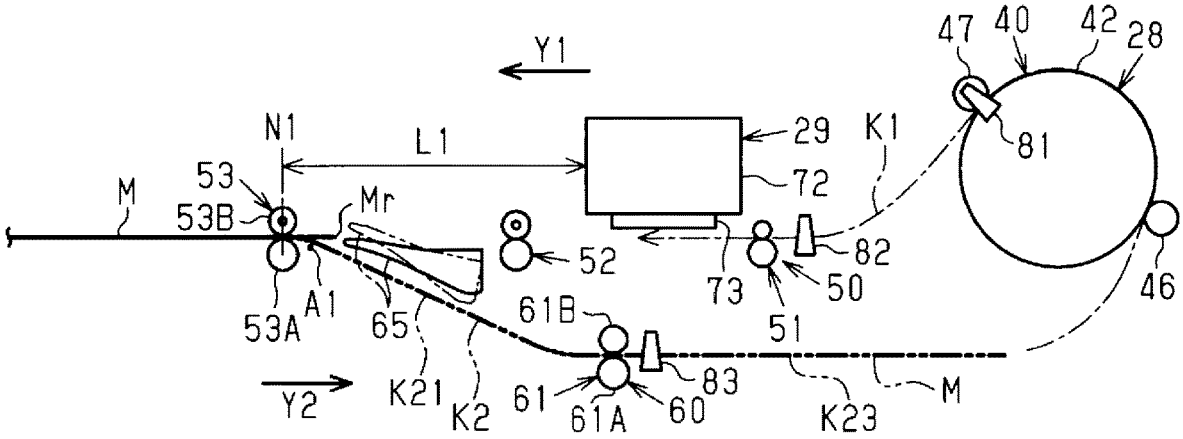
FIG. 8 is a schematic side sectional view for illustrating the double-sided printing on one sheet in the recording apparatus.

Next, the switchback operation for the double-sided printing on one sheet and the double-sided printing on a plurality of sheets will be described with reference to FIGS. 8 and 9. During the double-sided printing on one sheet, the second discharge roller pair 53 and the flap 65 are disposed at a first position illustrated in FIG. 8. As illustrated in FIG. 8, during the double-sided printing on one sheet, the switchback operation is performed by the second discharge roller pair 53. Further, during the double-sided printing on a plurality of sheets, the second discharge roller pair 53 and the flap 65 are disposed at a second position illustrated in FIG. 9, located downstream of the first position in the transport direction Y.

As illustrated in FIG. 8, when the second discharge roller pair 53 and the flap 65 are located at the first position, the transport distance between the position of the recording unit 29 and the nipping position N1 of the second discharge roller pair 53 corresponding to the connecting position between the first transport path K1 and the first retraction path K21 constituting the second transport path K2 is set as the first transport distance L1. In the case of a printing condition in which the double-sided printing is performed on one sheet of the medium M, the second discharge roller pair 53 and the flap 65 are disposed at the first position illustrated in FIG. 8, which is located on an upstream side in the transport direction Y. During the switchback operation, the medium M is drawn from the first retraction port A1 to the first retraction path K21 and is sent to the second transport path K2.

Figure 9:
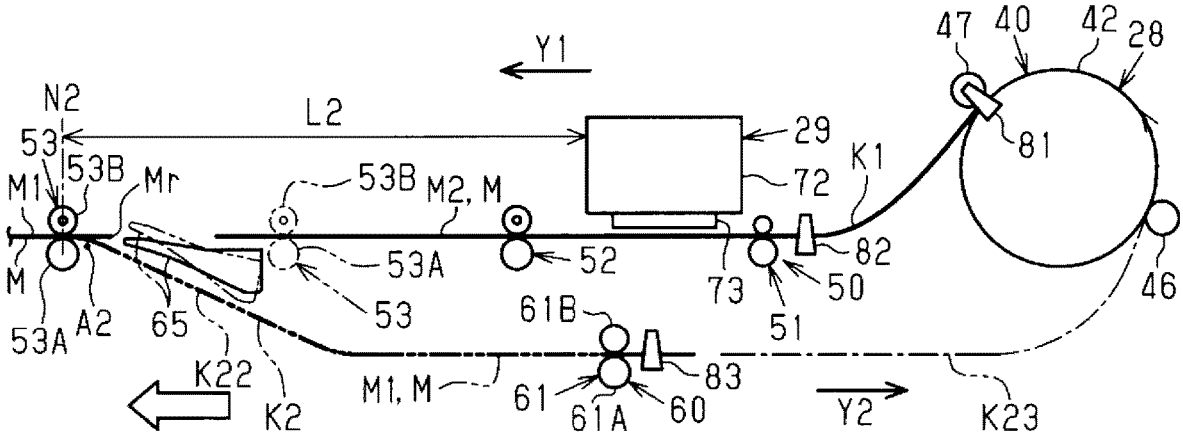
FIG. 9 is a schematic side sectional view for illustrating the double-sided printing on a plurality of sheets in the recording apparatus.

Further, as illustrated in FIG. 9, when the second discharge roller pair 53 and the flap 65 are located at the second position, the transport distance between the position of the recording unit 29 and the connecting position between the first transport path K1 and the second transport path K2, that is, the transport distance between the position of the recording unit 29 and the nipping position N2 of the second discharge roller pair 53, is set as the second transport distance L2 that is longer than the first transport distance L1. In the case of a printing condition in which the double-sided printing is performed on a plurality of sheets of the media M, the second discharge roller pair 53 and the flap 65 are disposed at the second position illustrated in FIG. 9, which is located downstream of the first position in the transport direction Y. During the switchback operation, the medium M is drawn from the second retraction port A2 located downstream of the first retraction port A1 in the first direction Y1 to the second retraction path K22 and is sent to the second transport path K2.

Figure 10:
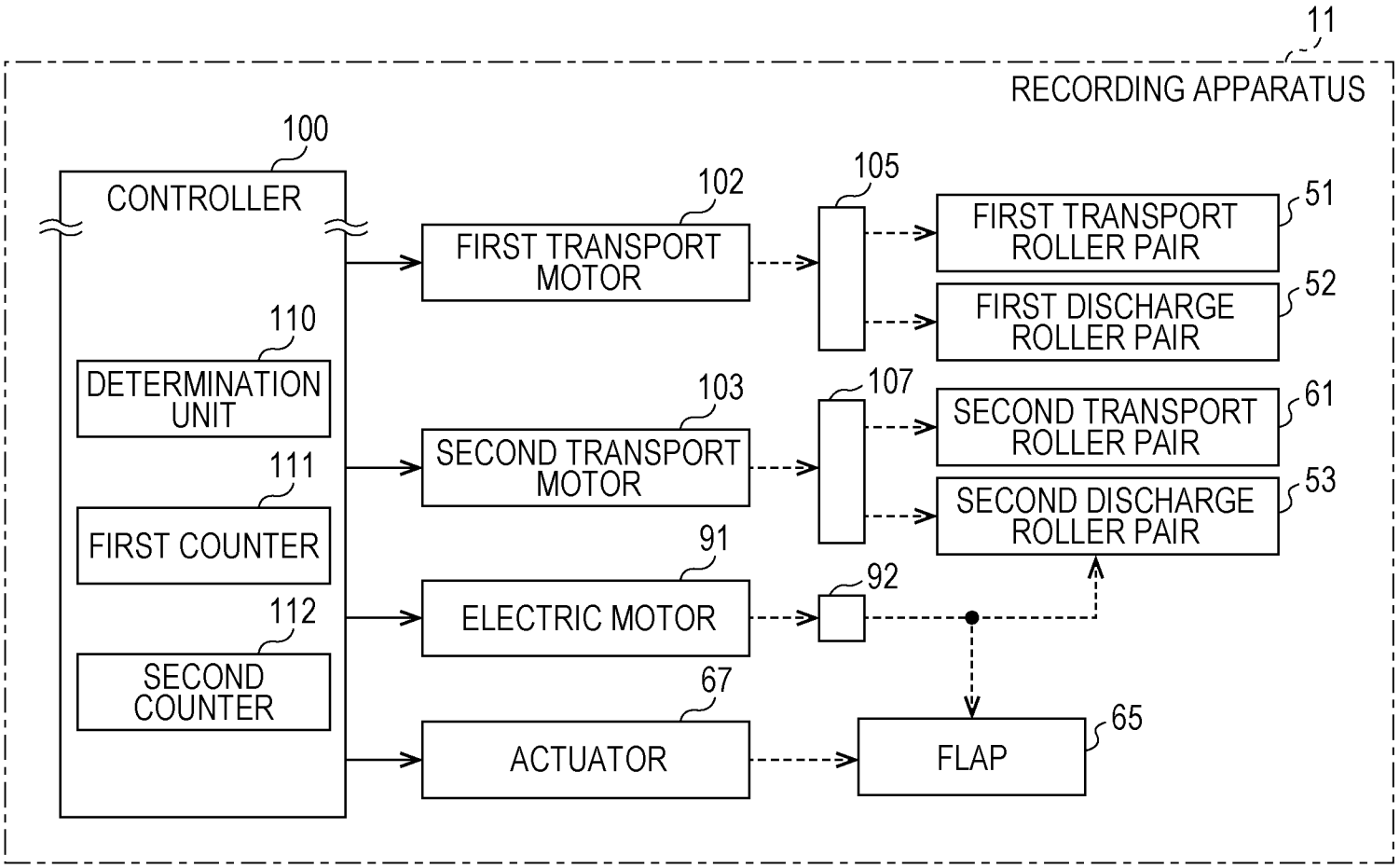
FIG. 10 is a block diagram illustrating an electric configuration of the recording apparatus.

Next, an electric configuration of the recording apparatus 11 will be described with reference to FIG. 10. Hereinafter, an electric configuration that is different from an electric configuration according to the first embodiment will be described. As illustrated in FIG. 10, the recording apparatus 11 includes an electric motor 91 as a power source that moves the second discharge roller pair 53 and the flap 65 in the transport direction Y. The electric motor 91 is electrically coupled to the controller 100. The second discharge roller pair 53 and the flap 65 is moved from the first position to the second position as the controller 100 causes the electric motor 91 to perform forward rotation driving, and is moved from the second position to the first position as the controller 100 causes the electric motor 91 to perform reverse rotation driving. The second discharge roller pair 53 and the flap 65 are coupled to each other to enable power transmission in a state in which the second discharge roller pair 53 and the flap 65 can move between the first position and the second position through the electric motor 91 and a driving mechanism 92. The driving mechanism 92 is configured with a linear motion mechanism, for example, a rack-and-pinion mechanism, that can convert a rotational motion into a linear motion. When the driving mechanism 92 is, for example, the rack-and-pinion mechanism, a rack is installed in a slider that supports the second discharge roller pair 53 and the flap 65 in a direction in which a longitudinal direction is matched with the transport direction Y, and a pinion fixed to an output shaft of the electric motor 91 is engaged with a tooth portion of the rack. Further, as illustrated in FIG. 10, as the actuator 67 electrically coupled to the controller 100 is driven, the flap 65 pivots between the first posture and the second posture. In the present example, the actuator 67 is attached to the slider together with the flap 65, and is configured to be movable along the transport direction Y together with the flap 65. The driving mechanism 92 may be configured with the other linear mechanism other than the rack-and-pinion mechanism.

The second transport motor 103 is coupled to the second discharge roller pair 53 and the second transport roller pair 61 through the gear mechanism 107 to enable power transmission. The second discharge roller pair 53 performs forward rotation when the second transport motor 103 performs forward rotation driving, to transport the medium M in the first direction Y1, and performs reverse rotation when the second transport motor 103 performs reverse rotation driving, to transport the medium M in the second direction Y2. Further, the second transport roller pair 61 is stopped when the second transport motor 103 performs forward rotation driving and performs reverse rotation when the second transport motor 103 performs reverse rotation driving, to transport the medium M in the second direction Y2 along the second transport path K2. For example, the medium M is transported in the second direction Y2 along the second transport path K2 by the reverse rotation driving of the second transport motor 103, and the medium M is stopped at the standby position before the first nipping position by the forward rotation driving of the second transport motor 103.

Next, the operation of the recording apparatus 11 according to the second embodiment will be described. Hereinafter, printing control of the recording apparatus 11 will be described for the double-sided printing on one sheet and the double-sided printing on a plurality of sheets. The controller 100 grasps an arrangement position of the second discharge roller pair 53 and the flap 65 by a not-illustrated sensor.

First, as illustrated in FIG. 8, in the case of a printing condition in which the double-sided printing is performed on one sheet of the medium M, when the second discharge roller pair 53 and the flap 65 are not in the first position, the controller 100 drives and controls the electric motor 91 so that the second discharge roller pair 53 and the flap 65 are disposed in the first position located on an upstream side in the transport direction Y and illustrated in FIG. 8. In a state in which the second discharge roller pair 53 and the flap 65 are located at the first position, the transport distance between the position of the recording unit 29 and the nipping position N1 of the second discharge roller pair 53 corresponding to the connecting position between the first transport path K1 and the first retraction path K21 constituting the second transport path K2 is set as the first transport distance L1. During the switchback operation, the medium M is drawn from the first retraction port A1 to the first retraction path K21 and is sent to the second transport path K2. In this case, the medium M switched back after the printing is terminated is reversed back and forth and is re-fed through the second transport path K2, and the transport path until the medium M is transported to a printing start position is relatively short. Therefore, the double-sided printing on one sheet can be performed at a high speed.

Further, as illustrated in FIG. 9, in the case of a printing condition in which the double-sided printing is performed on the plurality of sheets of the media M, when the second discharge roller pair 53 and the flap 65 are not in the second position, the controller 100 drives and controls the electric motor 91 so that the second discharge roller pair 53 and the flap 65 are disposed in the second position located downstream of the first position in the transport direction Y and illustrated in FIG. 9. In a state in which the second discharge roller pair 53 and the flap 65 are located at the second position, the transport distance between the position of the recording unit 29 and the nipping position N2 of the second discharge roller pair 53 is set as the second transport distance L2 illustrated in FIG. 9 that is longer than the first transport distance L1 illustrated in FIG. 8. Therefore, a long printable length of the following medium M2 can be secured.

During the switchback operation, the medium M is drawn from the second retraction port A2 located downstream of the first retraction port A1 in the first direction Y1 to the second retraction path K22 and is sent to the second transport path K2. In this case, even while the preceding medium M1 is switched back, even though the leading end of the following medium M2 passes through the first retraction port A1, the printing can continue up to the standby position before the leading end of the following medium M2 reaches the second retraction port A2. Therefore, because of the switchback operation of the preceding medium M1, the standby time during which the printing on the following medium M2 is temporarily stopped can be reduced. Therefore, even while the preceding medium M1 is switched back, the printing on the following medium M2 can substantially continue. Although the transport path length until the preceding medium M1 is reversed back and forth and re-fed through the second transport path K2 and is transported to the printing start position becomes relatively long, the standby time during which the printing on the following medium M2 is temporarily stopped can be eliminated or reduced. As a result, the double-sided printing on a plurality of sheets can be performed at a high speed. When the following medium M2 is switched back, in FIGS. 8 and 9, position control of the second discharge roller pair 53 and the flap 65 by driving control of the electric motor 91 by the controller 100 is performed in the same manner just by replacing the preceding medium M1 with the following medium M2. Therefore, even when the following medium M2 is switched back, the standby time during which the printing on the preceding medium M1 is temporarily stopped can be eliminated or reduced.

According to the second embodiment, the following effects can be obtained in addition to the effects (3) to (5) according to the first embodiment.

(6) The discharge roller pair 53 that can apply a transporting force in the first direction Y1 and the second direction Y2 to the recording medium M at a downstream position of the recording unit 29 in the first direction Y1 is included, and the transport distance can be changed by changing the position of the discharge roller pair 53. Thus, during the double-sided printing on one sheet, the discharge roller pair 53 disposed at a position (the first position) where the transport distance is set as the first transport distance L1 switches back the medium M after the recording and transports the medium M in the second direction Y2. In this case, the reverse path length by which the medium M is reversed can be shortened. Further, during the double-sided printing on a plurality of sheets, the discharge roller pair 53 disposed at a position (the second position) where the transport distance is set as the second transport distance L2 that is longer than the first transport distance L1 switches back the medium M and transports the medium M in the second direction Y2. In this case, although the reverse path length by which the medium M is reversed becomes longer, since the printing on the following medium M2 is performed until the switchback operation of the preceding medium M1 is terminated, a large printable area can be secured. Thus, throughput in both the double-sided printing on one sheet and the double-sided printing on a plurality of sheets can be improved.

(7) The position of the discharge roller pair 53 changes along the transport direction Y of the medium M. That is, since a direction in which the position of the discharge roller pair 53 is changed is the transport direction Y that is a direction in which the medium M is transported during the printing, the relatively large transport distance between the first transport distance L1 and the second transport distance L2 can be changed by changing the position of the discharge roller pair 53. Thus, throughput in both the double-sided printing on one sheet and the double-sided printing on a plurality of sheets can be effectively improved.

Third Embodiment

Next, a third embodiment will be described with reference to FIGS. 11 to 14. Similar to the second embodiment, the recording apparatus 11 according to the third embodiment is not provided with the third discharge roller pair 54, and the second discharge roller pair 53 is movable. As the second discharge roller pair 53 moves, the transport distance is variable. In the third embodiment, a movement direction of the second discharge roller pair 53 is different from that a movement direction of the second discharge roller pair 53 according to the second embodiment. Description of a configuration that is common to the configuration according to the first embodiment and the second embodiment will be omitted, and only particularly different configurations will be described.

The transport distance between the position of the recording unit 29 and the connecting position where the first transport path K1 and the second transport path K2 are connected to each other can be changed. The recording apparatus 11 includes the second discharge roller pair 53 as an example of a roller pair, which can apply a transporting force in the first direction Y1 and the second direction Y2 to the medium M at a downstream position of the recording unit 29 in the first direction Y1. As the position of the second discharge roller pair 53 is changed, the transport distance can be changed.

Figure 11:
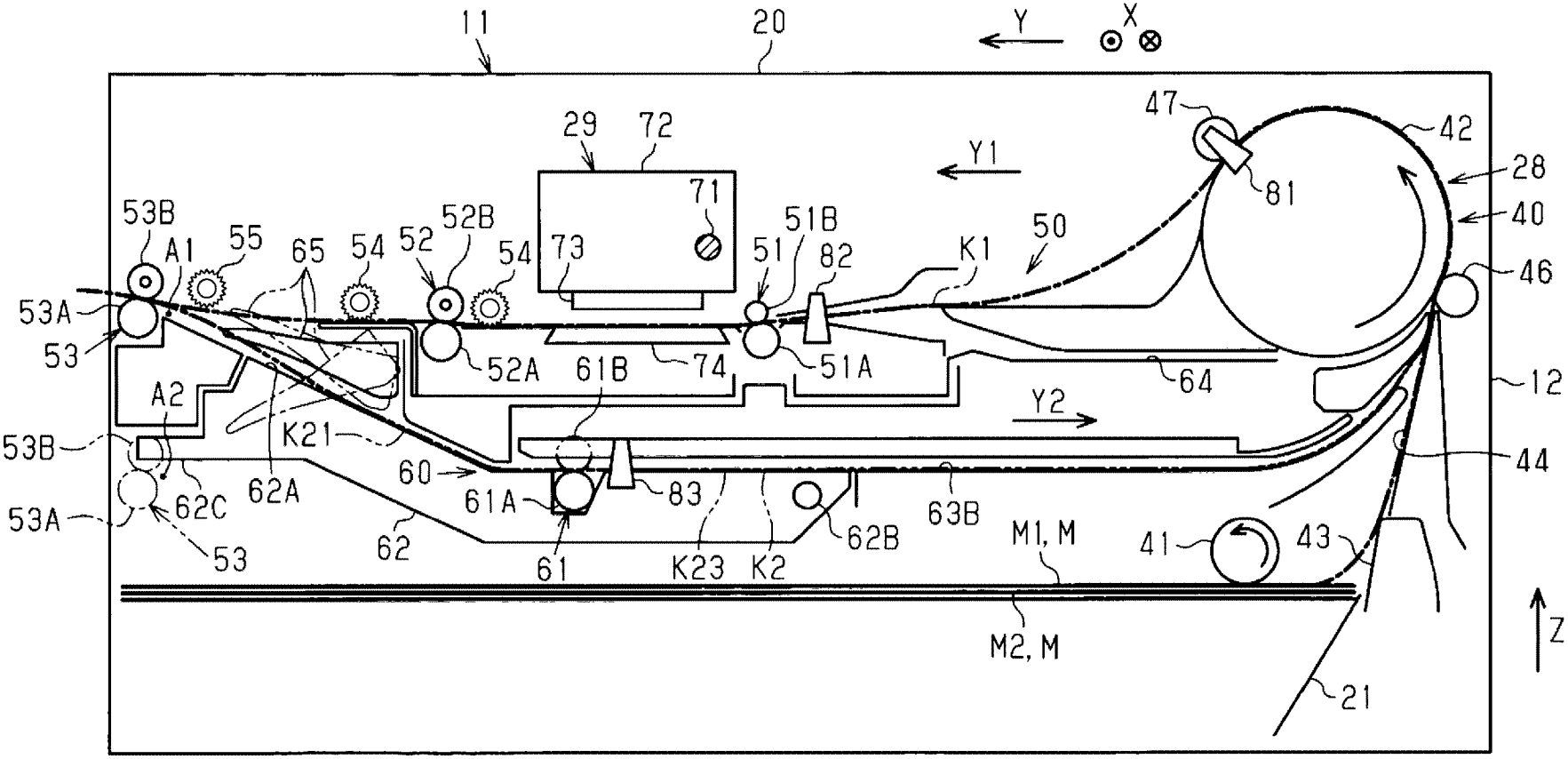
FIG. 11 is a schematic side sectional view for illustrating a recording apparatus according to a third embodiment.

As illustrated in FIG. 11, the second discharge roller pair 53 can change a position thereof along a direction intersecting the transport direction Y of the medium M. In an example illustrated in FIG. 11, the second discharge roller pair 53 is configured to be movable along the vertical direction Z. That is, the second discharge roller pair 53 is configured to be movable along the vertical direction Z between a first position indicated by a solid line of FIG. 11 and a second position located on a lower side of the first position in the vertical direction Z.

Further, the flap 65 located directly upstream of the second discharge roller pair 53 in the transport direction Y is configured to be pivotable between a plurality of postures including two different postures in which the medium M can be guided to the second discharge roller pair 53 according to a movement position of the second discharge roller pair 53 that moves along the vertical direction Z. That is, the flap 65 is disposed at a first posture indicated by the solid line of FIG. 11 in which the flap 65 supports the medium M guidably to the second discharge roller pair 53 when the second discharge roller pair 53 is disposed at the first position indicated by the solid line of FIG. 11. Further, the flap 65 is disposed at a first posture indicated by a two-dot chain line of FIG. 11 in which when the second discharge roller pair 53 is disposed at the first position indicated by a two-dot chain line of FIG. 11, the flap 65 supports the medium M guidably to the second discharge roller pair 53 and a leading end is tilted to the lower side from the first posture. In the present embodiment, a floating roller 55 provided for guiding the medium M to the second discharge roller pair 53 can also move in the vertical direction Z together with the second discharge roller pair 53.

Figure 12:
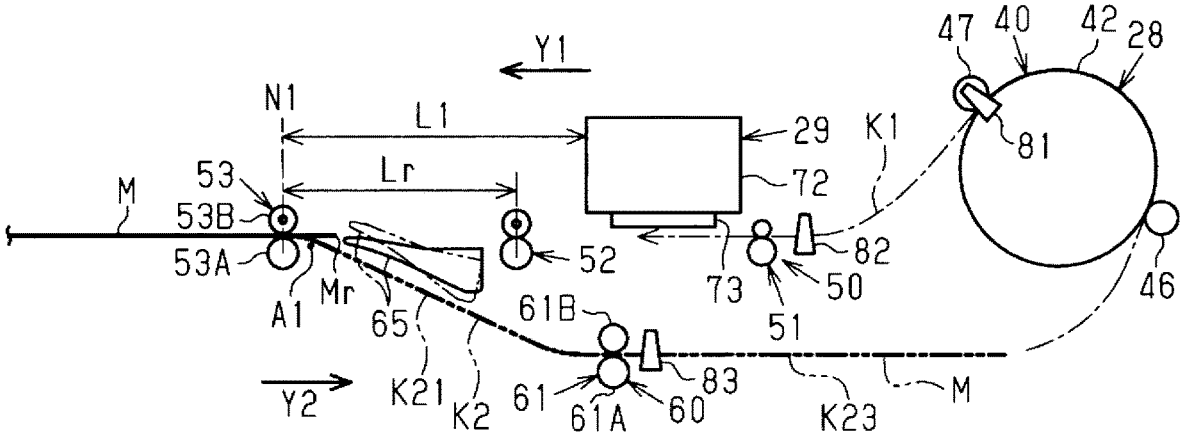
FIG. 12 is a schematic side sectional view for illustrating the double-sided printing on one sheet in the recording apparatus.

Next, the switchback operation for the double-sided printing on one sheet and the double-sided printing on a plurality of sheets will be described with reference to FIGS. 12 and 13. As illustrated in FIG. 12, during the double-sided printing on one sheet, the second discharge roller pair 53 is disposed at the first position, and the flap 65 is disposed at the first posture. During the switchback operation, the flap 65 is disposed at the second posture. Further, as illustrated in FIG. 13, during the double-sided printing on a plurality of sheets, the second discharge roller pair 53 is disposed at the second position located below the first position in the vertical direction Z, and the flap 65 is disposed at the third posture.

As illustrated in FIG. 12, the transport distance between the position of the recording unit 29 and the connecting position between the first transport path K1 and the second transport path K2, that is, the transport distance between the position of the recording unit 29 and the nipping position N1 of the second discharge roller pair 53 disposed at the first position, is set as the first transport distance L1. At this time, an interval between nipping positions of the first discharge roller pair 52 and the second discharge roller pair 53 is set as a distance Lr. In the case of a printing condition in which the double-sided printing is performed on one sheet of the medium M, the second discharge roller pair 53 is disposed at the first position, and the flap 65 is disposed at the first posture. During the switchback operation, the flap 65 is disposed at the second posture indicated by a two-dot chain line of FIG. 12, and the medium M is drawn from the first retraction port A1 to the first retraction path K21 and is sent to the second transport path K2.

Figure 13:
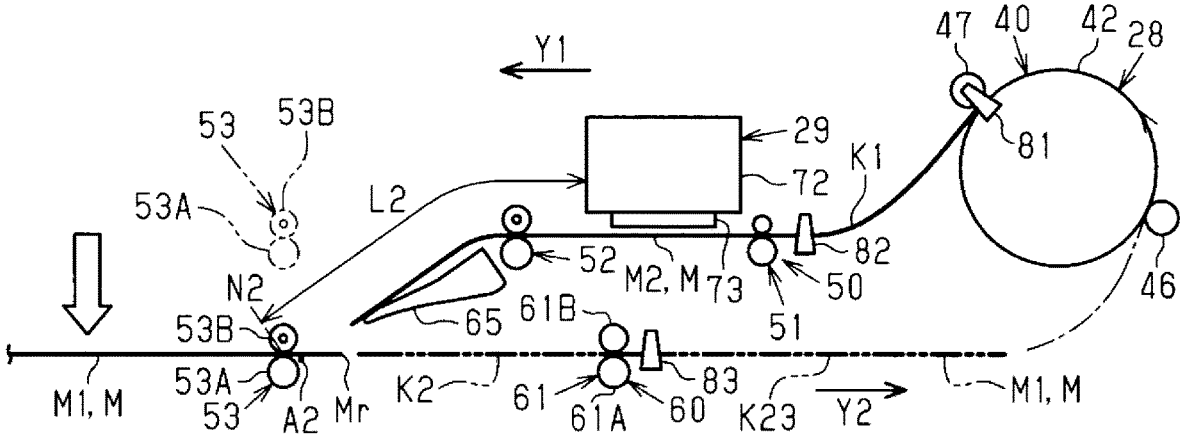
FIG. 13 is a schematic side sectional view for illustrating the double-sided printing on a plurality of sheets in the recording apparatus.

Further, in the case of a printing condition in which the double-sided printing is performed on a plurality of sheets of the media M, the second discharge roller pair 53 is moved from the first position to the lower side in the vertical direction Z as indicated by a hollow arrow of FIG. 13 and is disposed at the second position. Further, the flap 65 is disposed at a third posture in which the flap 65 pivots from the first posture in a counterclockwise direction and obliquely downwardly guides the medium M in the transport direction Y. Therefore, as illustrated in FIG. 13, the transport distance between the position of the recording unit 29 and the connecting position between the first transport path K1 and the second transport path K2, that is, the transport distance between the position of the recording unit 29 and the nipping position N2 of the second discharge roller pair 53 disposed at the second position, is set as the second transport distance L2 that is longer than the first transport distance L1. Here, when a posture angle when the flap 65 is in the first posture is set as a reference zero degree, and a posture angle when the flap 65 is in the third posture is set as 0, the second transport distance L2 is longer than the first transport distance L1 by $(1/\cos\theta-1)\cdot Lr$, and the second transport distance L2 is represented by $L2=L1+(1/\cos\theta-1)\cdot Lr$. For example, when $\theta=45°$, the second transport distance L2 is longer than the first transport distance L1 by about 0.4 Lr. During the switchback operation, the medium M is drawn from the second retraction port A2 located on a lower side of the first retraction port A1 to the second retraction path K22 and is sent to the second transport path K2.

Figure 14:
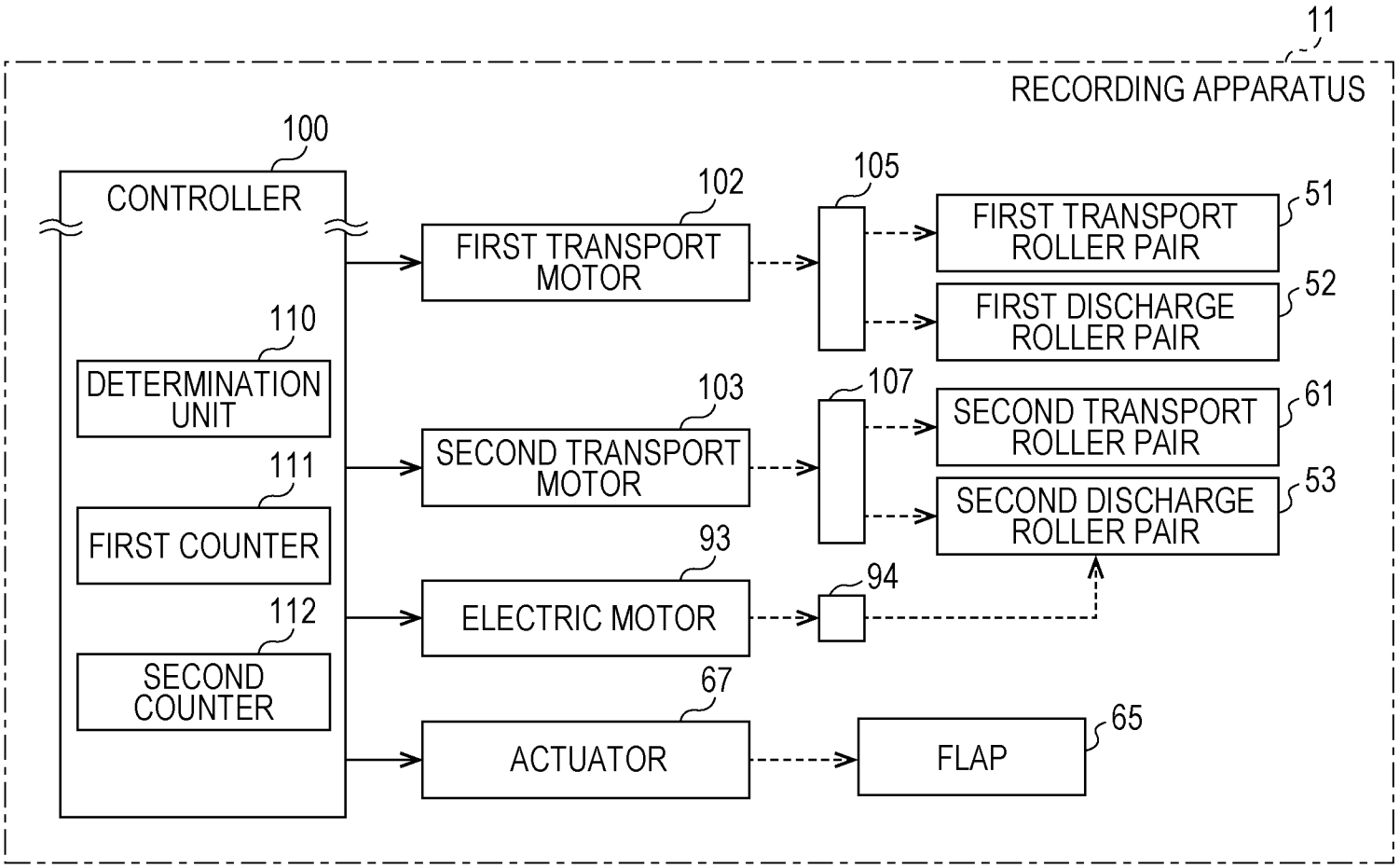
FIG. 14 is a block diagram illustrating an electric configuration of the recording apparatus.

Next, an electric configuration of the recording apparatus 11 will be described with reference to FIG. 14. Hereinafter, an electric configuration that is different from an electric configuration according to the first embodiment will be described. As illustrated in FIG. 14, the recording apparatus 11 includes an electric motor 93 as a power source that moves the second discharge roller pair 53 in the vertical direction Z. The electric motor 93 is electrically coupled to the controller 100. The electric motor 93 is coupled to the second discharge roller pair 53 through the driving mechanism 94 to enable power transmission. The driving mechanism 94 is configured with a linear motion mechanism, for example, a rack-and-pinion mechanism, that can convert a rotational motion into a linear motion. When the driving mechanism 94 is, for example, the rack-and-pinion mechanism, a rack is installed in a slider that supports the second discharge roller pair 53 in a direction in which a longitudinal direction is matched with the vertical direction Z, and a pinion fixed to an output shaft of the electric motor 93 is engaged with a tooth portion of the rack. The second discharge roller pair 53 is moved from the first position to the second position as the controller 100 causes the electric motor 93 to perform forward rotation driving, and is moved from the second position to the first position as the controller 100 causes the electric motor 93 to perform reverse rotation driving. The controller 100 grasps an arrangement position of the second discharge roller pair 53 and the flap 65 by a not-illustrated sensor. Further, as illustrated in FIG. 14, as the actuator 67 electrically coupled to the controller 100 is driven, the flap 65 pivots. By driving the actuator 67, the flap 65 may pivot between the first posture, the second posture, and the third posture. The driving mechanism 94 may be configured with the other linear mechanism other than the rack-and-pinion mechanism.

Next, the operation of the recording apparatus 11 according to the third embodiment will be described. Hereinafter, printing control of the recording apparatus 11 will be described for the double-sided printing on one sheet and the double-sided printing on a plurality of sheets. The controller 100 grasps an arrangement position of the second discharge roller pair 53 and the flap 65 by a not-illustrated sensor.

First, as illustrated in FIG. 12, in the case of a printing condition in which the double-sided printing is performed on one sheet of the medium M, when the second discharge roller pair 53 is not in the first position, the controller 100 drives and controls the electric motor 93 so that the second discharge roller pair 53 is disposed in the first position located on an upstream side in the vertical direction Z and illustrated in FIG. 12. First, the controller 100 drives and controls the actuator 67 to dispose the flap 65 in the first posture.

As illustrated in FIG. 12, in a state in which the second discharge roller pair 53 is located at the first position, the second discharge roller pair 53 corresponding to the connecting position between the first transport path K1 and the second transport path K2 is disposed at the first position. Accordingly, the transport distance between the position of the recording unit 29 and the nipping position N1 of the second discharge roller pair 53 corresponding to the connecting position between the first transport path K1 and the second transport path K2 is set as the first transport distance L1. During the switchback operation by the second discharge roller pair 53 disposed at the first position, the medium M is guided to the lower side by the flap 65 disposed at the second posture, is drawn from the first retraction port A1 to the first retraction path K21, and is sent to the second transport path K2. In this case, a transport path length until the medium M drawn from the first retraction port A1 is reversed back and forth through the second transport path K2 and is re-fed to the printing start position is relatively short, as compared to a case where the medium M is drawn from the second retraction port A2 as illustrated in FIG. 9. Therefore, the double-sided printing on one sheet can be performed at a high speed.

Further, in the case of a printing condition in which the double-sided printing is performed on a plurality of sheets of media M, when the second discharge roller pair 53 is not located at the second position, the controller 100 drives and controls the electric motor 93 to move the second discharge roller pair 53 from the first position as indicated by a two-dot chain line of FIG. 13 to the lower side in the vertical direction Z as indicated by a hollow arrow of the same drawing. As a result, the second discharge roller pair 53 is disposed at the second position as illustrated in FIG. 13. Further, the controller 100 drives and controls the actuator 67 to move the flap 65 from the first posture in a counterclockwise direction so as to dispose the flap 65 at the third posture in which the medium M can be guided obliquely downward in the first direction Y1 as illustrated in FIG. 13.

At this time, as illustrated in FIG. 13, the transport distance between the position of the recording unit 29 and the nipping position N2 of the second discharge roller pair 53 disposed at the second position is set as the second transport distance L2 that is longer than the first transport distance L1. During the switchback operation, when the trailing end Mr of the preceding medium M1 passes through the flap 65 in the first direction Y1 by the forward rotation of the second discharge roller pair 53, the forward rotation of the second discharge roller pair 53 is changed to the reverse rotation. The preceding medium M1 switched back by the reverse rotation of the second discharge roller pair 53 is drawn from the second retraction port A2 located below the first retraction port A1 to the second transport path K2. Thus, as indicated by a thick two-dot chain line of FIG. 13, the preceding medium M1 is fed on the second transport path K2 in the second direction Y2.

In this case, even while the preceding medium M1 is switched back, since the transport distance is longer than the transport distance when the second discharge roller pair 53 is located at the first position, the printing on the following medium M2 can continue longer. Therefore, because of the switchback operation of the preceding medium M1, even when the standby time during which the printing on the following medium M2 is temporarily stopped is required, the standby time is shortened. Therefore, even while the preceding medium M1 is switched back, the printing on the following medium M2 can substantially continue. Thus, the standby time during which the printing on the following medium M2 is temporarily stopped can be eliminated or reduced. As a result, the double-sided printing on a plurality of sheets can be performed at a high speed. When the following medium M2 is switched back, in FIGS. 12 and 13, position control of the second discharge roller pair 53 and the flap 65 and posture angle control of the flap 65 by driving and controlling the electric motor 93 by the controller 100 are performed in the same manner just by replacing the preceding medium M1 with the following medium M2. Therefore, even while the following medium M2 is switched back, the standby time during which the printing on the preceding medium M1 is temporarily stopped can be eliminated or reduced.

According to the third embodiment, the following effects can be obtained in addition to the effects (3) to (5) according to the first embodiment and the effect (6) according to the second embodiment.

(8) The position of the discharge roller pair 53 changes along the vertical direction Z that is a direction intersecting the transport direction Y of the medium M and the width direction X of the medium M. Thus, it is possible to secure a relatively large distance for changing the transport distance as compared to a distance for changing the position of the discharge roller pair 53.

Fourth Embodiment

Next, a fourth embodiment will be described with reference to FIGS. 15 to 17. The recording apparatus 11 according to the fourth embodiment differs from the recording apparatus 11 according to the second and third embodiments, and the second discharge roller pair 53 is not movable. The flap 65 is largely advanced to the first transport path K1 and the medium M is deformed by the flap 65, so that the transport distance between the position of the recording unit 29 and the nipping position of the second discharge roller pair 53 can vary. Description of a configuration that is common to the configuration according to the first to third embodiments will be omitted, and only particularly different configurations will be described.

Figure 15:
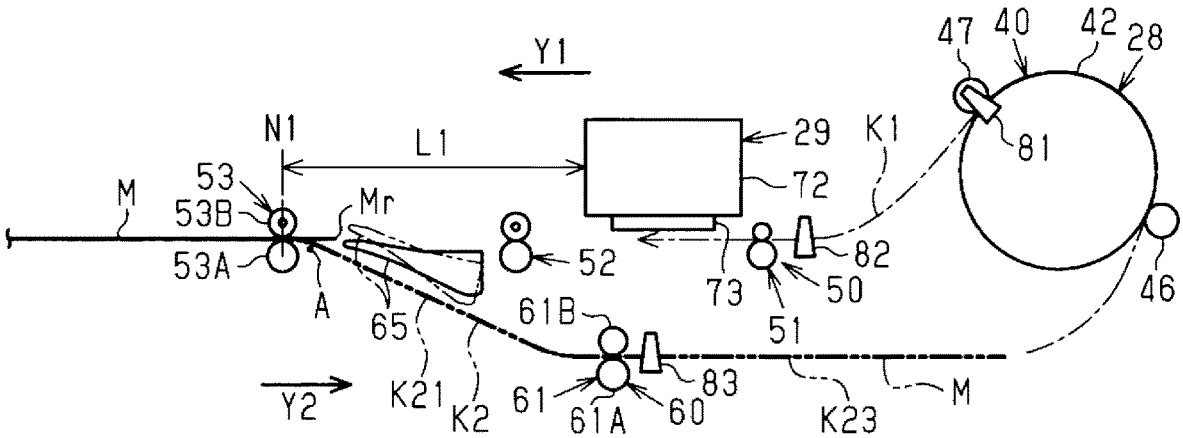
FIG. 15 is a schematic side sectional view for illustrating the double-sided printing on one sheet in a recording apparatus according to a fourth embodiment.
Figure 16:
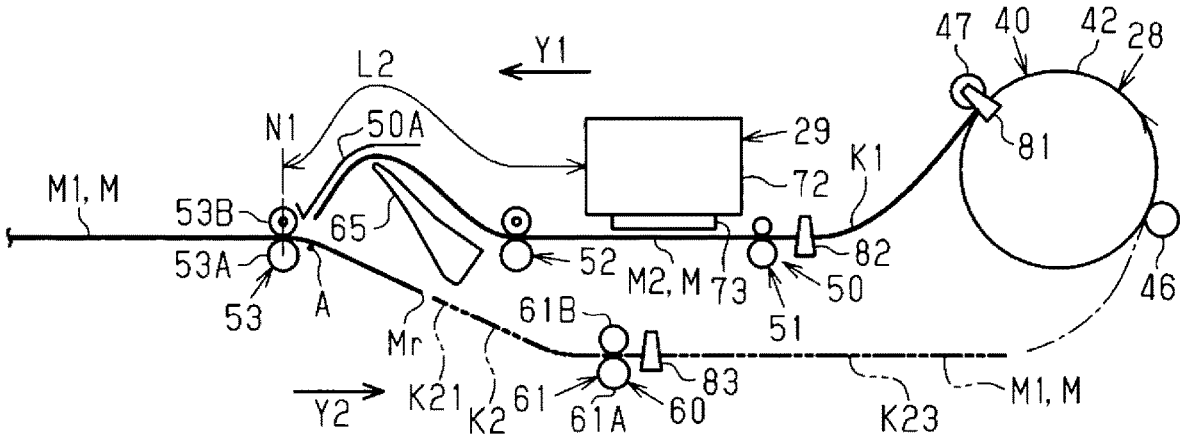
FIG. 16 is a schematic side sectional view for illustrating the double-sided printing on a plurality of sheets in the recording apparatus.
Figure 17:
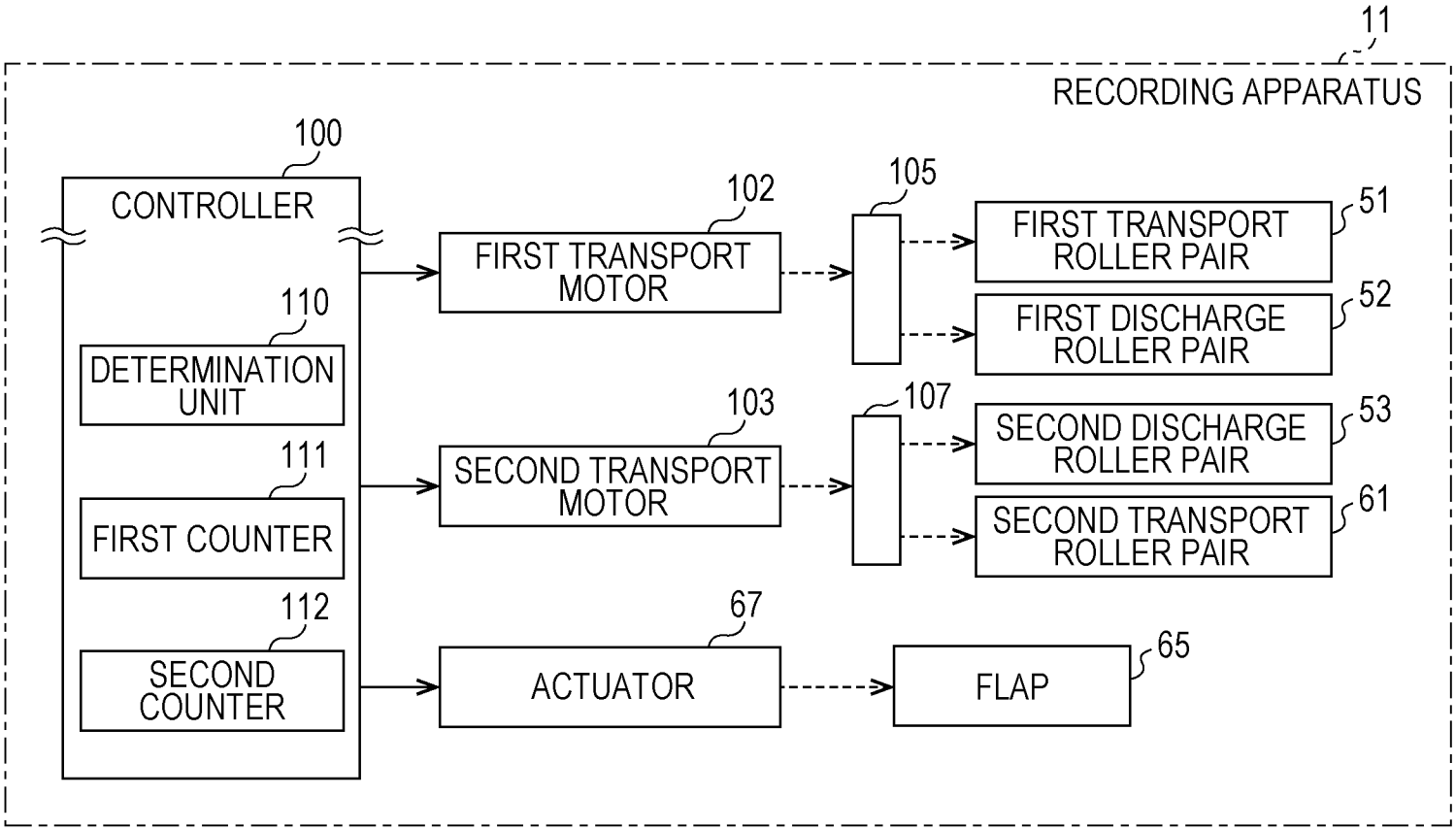
FIG. 17 is a block diagram illustrating an electric configuration of the recording apparatus.

As illustrated in FIGS. 15 and 16, the transport distance between the position of the recording unit 29 and the connecting position between the first transport path K1 and the second transport path K2, that is, the transport distance between the position of the recording unit 29 and the nipping position N1 of the second discharge roller pair 53, can be changed. The recording apparatus 11 includes the second discharge roller pair 53 as an example of a roller pair, which can apply a transporting force in the first direction Y1 and the second direction Y2 to the medium M at a downstream position of the recording unit 29 in the first direction Y1. Further, the recording apparatus 11 includes the flap 65 as an example of a deformable member, which is located upstream of the second discharge roller pair 53 in the first direction Y1. The flap 65 can be displaced between the advanced position where the medium M is advanced close to the first transport path K1 and the retracted position where the medium M is more retracted from the first transport path K1 than the advanced position as indicated by a solid line of FIG. 15. Further, similar to each embodiment, the flap 65 is disposed at the second posture where the medium M when being switched back can be guided to the second transport path K2 as indicated by a two-dot chain line of FIG. 15. Here, the retracted position as indicated by the solid line of FIG. 15 corresponds to the first posture according to each embodiment.

In a state in which the flap 65 is disposed at the advanced position as indicated by a solid line of FIG. 16, the flap 65 is further advanced to the first transport path K1 than a case where the flap 65 is located at the second posture. Thus, as the flap 65 is disposed at the advanced position, the transport path can be deformed by pushing up and supporting the medium M transported on the first transport path K1 as illustrated in FIG. 16. Therefore, when the flap 65 is disposed at the advanced position, the transport distance of the medium M can be changed to a larger value by deformation of the medium M than when the flap 65 is disposed at the retracted position.

Next, the switchback operation for the double-sided printing on one sheet and the double-sided printing on a plurality of sheets will be described with reference to FIGS. 15 and 16. As illustrated in FIG. 15, in the double-sided printing on one sheet, in a state in which the flap 65 is located at the first posture, the printing on the medium M is performed. When the trailing end Mr of the medium M on which the printing is terminated passes through the flap 65 in the first direction Y1, the flap 65 is disposed at the second posture as indicated by a two-dot chain line of FIG. 15, the forward rotation of the second discharge roller pair 53 is changed to the reverse rotation, and the medium M is switched back. During the switchback operation, as the flap 65 is disposed at the second posture in which the medium M can be guided to the second transport path K2, the switched back medium M is guided to the lower side by the flap 65, and is drawn from a retraction port A to the second transport path K2.

As illustrated in FIG. 15, when the second discharge roller pair 53 is located at the first position, the transport distance between the position of the recording unit 29 and the nipping position N1 of the second discharge roller pair 53 that is the connecting position between the first transport path K1 and the second transport path K2 is set as the first transport distance L1. Further, as illustrated in FIG. 16, in the case of a printing condition in which the double-sided printing on a plurality of sheets of media M, the flap 65 pivots in a clockwise direction in FIG. 15 from the retracted position (the first posture) as indicated by the solid line of FIG. 15 and is disposed at the advanced position as illustrated in FIG. 16. The preceding medium M1 during the printing is pushed up, is supported, and is deformed on the flap 65 disposed at the advanced position. Thus, as illustrated in FIG. 16, in a state in which the flap 65 is disposed at the advanced position, the transport distance between the position of the recording unit 29 and the nipping position N1 of the second discharge roller pair 53 is set as the second transport distance L2 that is longer than the first transport distance L1. During the switchback operation, the flap 65 is held at the advanced position illustrated in FIG. 16, and the switched back preceding medium M1*l* is guided to a lower side of the flap 65, and is drawn from the retraction port A to the second transport path K2. A guide member 50A that guides the medium M lifted up and deformed by the flap 65 disposed at the advanced position to the second discharge roller pair 53 is disposed in the vicinity of the position of a rotating leading end of the flap 65 located at the advanced position.

Next, an electric configuration of the recording apparatus 11 will be described with reference to FIG. 17. Hereinafter, an electric configuration that is different from an electric configuration according to the first embodiment will be described. As illustrated in FIG. 17, as the actuator 67 electrically coupled to the controller 100 is driven, the flap 65 is configured to be pivotable between the retracted position (the first posture), the second posture, and the advanced position taking a posture more advanced to the first transport path K1 than the second posture. The controller 100 is electrically coupled to a not-illustrated sensor that can grasp the posture angle of the flap 65.

Next, the operation of the recording apparatus 11 according to the fourth embodiment will be described. Hereinafter, printing control of the recording apparatus 11 will be described for the double-sided printing on one sheet and the double-sided printing on a plurality of sheets. The controller 100 grasps the posture angle of the flap 65 by the not-illustrated sensor.

First, as illustrated in FIG. 15, in the case of the printing condition in which the double-sided printing is performed on one sheet of the medium M, when the flap 65 is not located at the retracted position, the controller 100 drives and controls the actuator 67 to dispose the flap 65 at the retracted position indicated by a solid line of FIG. 15.

As illustrated in FIG. 15, in a state in which the flap 65 is disposed at the retracted position, the transport distance between the position of the recording unit 29 and the nipping position N1 of the second discharge roller pair 53 is set as the first transport distance L1. When the trailing end Mr of the medium M on which the printing is terminated passes through the flap 65 in the first direction Y1, the flap 65 is disposed at the second posture from the retracted position, the forward rotation of the second discharge roller pair 53 is changed to the reverse rotation, and the switchback operation is performed. The switched back medium M is guided to the lower side from the first retraction port A1 by the flap 65 as indicated by a thick two-dot chain line of FIG. 15, is drawn into the first retraction path K21, and is sent to the second transport path K2. The medium M is reversed back and forth through the second transport path K2, and is re-fed to the printing start position. In this case, since the medium M after the printing is terminated is switched back from the position of the recording unit 29 by the second discharge roller pair 53 located at the position of the transport distance L1, the transport path length until the medium M is reversed back and forth through the second transport path K2 and is re-fed to the printing start position is relatively short. Therefore, the double-sided printing on one sheet can be performed at a high speed.

Further, in the case of the printing condition in which the double-sided printing is performed on a plurality of sheets of the media M, when the flap 65 is not located at the advanced position, the controller 100 drives and controls the actuator 67 to dispose the flap 65 from the retracted position indicated by the solid line of FIG. 15 to the advanced position indicated by the solid line of FIG. 16 where the flap 65 is pivoted in a clockwise direction. At this time, as illustrated in FIG. 16, the transport distance between the position of the recording unit 29 and the nipping position N1 of the second discharge roller pair 53 is set as the second transport distance L2 that is longer than the first transport distance L1 by an amount by which the medium M is deformed. The preceding medium M1 on which the printing is terminated is deformed by being pushed up and supported by the flap 65 disposed at the advanced position illustrated in FIG. 16 and is discharged in the first direction Y1 along the deformed path.

The switchback operation is performed by changing the forward rotation of the second discharge roller pair 53 to the reverse rotation, after the trailing end Mr of the preceding medium M1 in the first direction Y1 passes through the flap 65 located at the advanced position. Here, the transport distance between a rotational leading end of the flap 65 and the nipping position N1 of the second discharge roller pair 53 is relatively longer when the flap 65 is disposed at the advanced position than when the flap 65 is disposed at the retracted position. Therefore, the length of the medium M in a portion extending in the second direction Y2 from the second discharge roller pair 53 when the preceding medium M1 on which the printing is terminated and the trailing end Mr of the preceding medium M1 is dropped to the lower side of the flap 65 is longer when the flap 65 is disposed at the advanced position than when the flap 65 is disposed at the retracted position. That is, the length of the medium in a portion extending in the second direction Y2 from the nipping position N1 of the second discharge roller pair 53 at a time point when the switchback operation of changing the preceding medium M1 from transportation to reverse transportation starts is longer when the flap 65 is disposed at the advanced position (see FIG. 16) than when the flap 65 is disposed at the retracted position (see FIG. 15). As a result, the transport distance by which the preceding medium M1 needs to be transported from start to end of the switchback operation can be relatively short. Therefore, the switchback operation of the preceding medium M1, which is performed after the printing, may be terminated at an early time.

Further, as the flap 65 is disposed at the advanced position, a printable length of the following medium M2 until the leading end of the following medium M2 reaches the nipping position N1 of the second discharge roller pair 53 is set as the second transport distance L2 that is longer than the first transport distance L1. Moreover, as mentioned above, since the switchback operation of the preceding medium M1 can be terminated early, even when the standby time during which the printing on the following medium M2 is temporarily stopped for the switchback operation of the preceding medium M1 occurs, the standby time can be relatively short. Therefore, even while the preceding medium M1 is switched back, the printing on the following medium M2 can substantially continue without the standby time. Further, when the following medium M2 is switched back, in FIGS. 15 and 16, position control of the flap 65 by driving and controlling the actuator 67 by the controller 100 is performed in the same manner just by replacing the preceding medium M1 with the following medium M2. Therefore, even when the following medium M2 is switched back, the standby time during which the printing on the preceding medium M1 is temporarily stopped can be eliminated or reduced. In this way, the double-sided printing on a plurality of sheets can be performed at a high speed.

According to the fourth embodiment, the following effects can be obtained in addition to the effects (3) to (5) according to the first embodiment.

(9) The recording apparatus 11 includes the second discharge roller pair 53 which can apply a transporting force in the first direction Y1 and the second direction Y2 to the medium M at a downstream position of the recording unit 29 in the first direction Y1 and the flap 65 disposed upstream of the second discharge roller pair 53 in the first direction Y1. The flap 65 can be displaced between the advanced position where the medium M is advanced close to the first transport path K1 and the retracted position where the medium M is more retracted from the first transport path K1 than the advanced position. The transport distance is changed not by disposing, at the retracted position, the medium M transported on the first transport path K1 by the flap 65 disposed at the advanced position, but by deforming the medium M. That is, as the flap 65 is disposed at the advanced position, a longer transport distance of the medium M than when the flap 65 is disposed at the retracted position can be secured. Thus, the transport distance between the position of the recording unit 29 and the nipping position N1 of the second discharge roller pair 53 can be changed using a relatively simple configuration. In the double-sided printing on one sheet, the flap 65 is disposed at the retracted position (the first posture) where the transport distance is set as the first transport distance L1. Further, during the double-sided printing on a plurality of sheets, the flap 65 is disposed at the advanced position where the transport distance is set as the second transport distance L2 that is longer than the first transport distance L1. Thus, throughput in both the double-sided printing on one sheet and the double-sided printing on a plurality of sheets can be improved.

The above-described embodiment can be changed to the following form.

In the second and third embodiments, a change in the position of the second discharge roller pair 53 is not limited to two positions, and may be continuously variable.

In the second and third embodiments, the second discharge roller pair 53 may be continuously variable according to a paper sheet length (a medium size) and a mode (the double-sided printing on one sheet or the double-sided printing on a plurality of sheets).

In each embodiment, a recording apparatus including a double-sided printing function and a face-down discharge function may be provided. In this case, throughput in both the face-down discharge printing on one sheet and the face-down discharge printing on a plurality of sheets can be improved.

The position of the following medium M2 at a time point when the switchback operation of the preceding medium M1 is terminated is not limited to a medium size (the length of the medium in the transport direction), and varies according to a printing pattern. For example, a retraction port may be changed in accordance with a required transport distance by analyzing the print pattern during a print job. That is, selection of a roller pair used for the switchback operation among the plurality of roller pairs 53 and 54 in the first embodiment, changing according to the printing pattern of an arrangement position of the roller pair 53 in the second and third embodiments, and changing according to the printing pattern of an operation position of the flap 65 as an example of a deformable member in the fourth embodiment may be performed.

In each embodiment, although two discharge roller pairs 52 and 53 are included, one discharge roller pair 53 may be used. In this case, the one discharge roller pair 53 may be disposed at the position of the first discharge roller pair 52 in FIG. 2, and the flap 65 may be disposed in the second direction Y2 of this discharge roller pair 53.

The first transport mechanism 50 may include at least a part of a transport belt for transporting the medium M.

The second transport path is not limited to a lower path with respect to the first transport path K1 and may be an upper path.

The second transport path is not limited to a configuration which is joined before reaching the reverse path with respect to the first transport path K1, and may be a path which is joined after passing through the reverse path with respect to the first transport path K1. That is, the second transport path may include the reverse path, and may be joined to the first transport path after the medium is reversed on the second transport path.

The second transport path K2 may have a path length that can correspond to A3 size. In this case, for example, in the case of a medium having A3 size, the medium is reversed through the second transport path K2. In the case of a medium having A4 size, as the medium M is reversely transported on the first transport path K1 when printing on the surface of the medium M is performed, and returns to the intermediate roller 42 through the reverse passage 64, the medium M is quickly reversed on a short transport path, so that the double-sided printing may be performed at a high speed.

The deformable member is not limited to a configuration also serving as a member for guiding the medium to the second transport path K2, which is like a flap. The deformable member may be also a dedicated flap that aims to change the medium M by pushing and deforming the medium M in a direction intersecting the transport direction Y. Further, the deformable member is not limited to a configuration that reciprocates and pivots like a flap, and may be a rotary configuration in which an advanced amount by which the deformable member rotates in one direction and is advanced to the first transport path K1 is changed according to a rotation position. Further, when the deformable member does not serve as the flap for guiding the medium M, the medium M may be deformed by pushing the medium M downward.

The deformable member is not limited to the flap. The deformable member may be a configuration that can push and deform the medium M in a direction intersecting the transport direction. In this case, the deformable member is not limited to a rotary configuration such as the flap, and may also be a configuration that slides in a direction intersecting the transport direction Y of the medium.

In the first and third embodiments, in the fourth embodiment, the flap 65 as an example of the deformable member may be provided together. With this configuration, the transport distance can be changed to a larger extent by both a change in the transport distance by selection of one used for the switchback operation among the plurality of roller pairs and a change in the transport distance by the deformable member. Thus, throughput in both printing accompanied by reverse of the medium and printing on a plurality of sheets can be improved.

A sensor that detects whether the medium is guided to the second transport path K2 by the flap 65 may be provided below the flap 65.

The recording apparatus is not limited to a multi-functional peripheral, and may be a printing-dedicated printer that does not have a scanner mechanism and a copy function.

The recording apparatus may be a dot impact type printer or an electrophotographic type printer in addition to an ink jet type printer.

The recording apparatus may be a line printer employing a line printing method as the recording unit 29. The recording head 73 employing the line printing method is a line head having an elongated shape that is slightly longer than the maximum width of the medium in the width direction intersecting the transport direction Y, and performs printing by simultaneously ejecting a one-line ink to the medium M transported at a constant speed according to a printing mode.

In the recording apparatus, the controller 100 may be realized by, for example, hardware by an electronic circuit (for example, a semiconductor integrated circuit) such as a field-programmable gate array (FPGA) and an application specific IC (ASIC) in addition to a configuration realized by software using a computer that executes a program or may be realized by cooperation between software and hardware.

The medium is not limited to a paper sheet, and may be a synthetic resin film or sheet, cloth, nonwoven fabric, laminate sheet or the like.

When the recording apparatus is a liquid ejecting apparatus that performs recording on the medium by ejecting a liquid, the medium is not limited to a color ink, and may be transparent ink. Further, the liquid may be a dye ink, a pigment ink, a solvent-based ink, or an ultraviolet curable ink which is cured by irradiation with ultraviolet light.

What is claimed is:

1. A recording apparatus comprising:

a recording unit that performs recording on a recording medium;

a first transport path through which the recording medium is transported in a first direction during the recording by the recording unit;

a second transport path which is connected to the first transport path at a downstream position of the recording unit in the first direction and through which the recording medium recorded by the recording unit is transported on a path that is different from the first transport path in a second direction that is different from the first direction; and a roller pair that is configured to apply a transporting force in the first direction and the second direction to the recording medium at a downstream position of the recording unit in the first direction, wherein a transport distance between a position of the recording unit and a connecting position where the first transport path and the second transport path are connected to each other is configured to be changed, wherein, the transport distance is configured to be changed by changing a position of the roller pair.

2. The recording apparatus according to claim 1, further comprising:

another roller pair that is configured to apply a transporting force in the first direction and the second direction to the recording medium at the downstream position of the recording unit in the first direction, wherein the transport distance is configured to be changed by changing one of the roller pair and the another roller pair that applies the transporting force to the recording medium in the second direction.

3. The recording apparatus according to claim 1, wherein the position of the roller pair is changed along a transport direction of the recording medium.

4. The recording apparatus according to claim 1, wherein the position of the roller pair is changed along a direction intersecting a transport direction of the recording medium and a width direction of the recording medium.

5. The recording apparatus according to claim 1, further comprising:

a deformable member that is disposed upstream of the roller pair in the first direction, and is configured to be displaced between an advanced position where the deformable member is advanced to the first transport path and a retracted position where the deformable member is more retracted from the first transport path than the advanced position, wherein the transport distance is changed by deforming the recording medium transported on the first transport path more by the deformable member disposed at the advanced position than by the deformable member disposed at the retracted position.

6. The recording apparatus according to claim 1, further comprising:

a first transport mechanism that transports the recording medium along the first transport path in the first direction in an area including an area facing the recording unit; and a second transport mechanism that transports the recording medium along the second transport path in the second direction.

7. The recording apparatus according to claim 1, wherein the second transport path is a reverse path that is joined to the first transport path at an upstream position of the recording unit in the first direction.

* * * * *